US005094136A

United States Patent [19]

Kudo et al.

[11] Patent Number: 5,094,136

[45] Date of Patent: Mar. 10, 1992

[54] ELECTRONIC MUSICAL INSTRUMENT HAVING PLURAL DIFFERENT TONE GENERATORS EMPLOYING DIFFERENT TONE GENERATION TECHNIQUES

[75] Inventors: Masaki Kudo; Tokio Ogi; Tsutomu Yanase; Tetsuji Ichiki, all of Hamamatsu, Japan

[73] Assignee: Yamaha Corporation, Hamamatsu, Japan

[21] Appl. No.: 460,502

[22] Filed: Jan. 3, 1990

[30] Foreign Application Priority Data

Jan. 6, 1989 [JP] Japan ..... 1-64950
Jan. 6, 1989 [JP] Japan ..... 1-64951
Jan. 6, 1989 [JP] Japan ..... 1-64952

[51] Int. Cl.[5] ..... G10H 1/057; G10H 1/14; G10H 7/02

[52] U.S. Cl. ..... 84/603; 84/624; 84/627

[58] Field of Search ..... 84/601-608, 84/622-625, 627, 630, 631, DIG. 4, DIG. 26, 662-664

[56] References Cited

U.S. PATENT DOCUMENTS 4,389,915 6/1983 Bione ..... 84/603
4,395,931 8/1983 Wachi ..... 84/603
4,726,276 2/1988 Katoh et al. ..... 84/663
4,766,795 8/1988 Takeuchi ..... 84/1.01
4,909,121 3/1990 Usa et al. ..... 84/622 X

FOREIGN PATENT DOCUMENTS 58-102296 6/1983 Japan .

*Primary Examiner*—Stanley J. Witkowski
*Attorney, Agent, or Firm*—Graham & James

[57] ABSTRACT

Two tone generators having different tone generation systems, e.g., PCM type and FM type, are provided. There are tone generation modes designating combination of tone generation in these tone generators and one can be selected from among them. There are, for example, a simple mixing mode, a delay mode in which start of tone generation in one tone generator is delayed from that in the other and a crossfade mode in which a tone signal is generated first in one tone generator and tone generation is switched to the other tone generator and envelope levels of output tone signals of the two tone generators are crossfaded during a switching period. Delay time in the delay mode and switching time in the crossfade mode can be variably controlled in accordance with a key scaling and/or other factors. A tone may be generated at a sampling frequency synchronized with a pitch in one tone generator and at a sampling frequency which is not synchronized with the pitch in the other tone generator. A phase of one cycle may be divided into plural sections and a complex waveform can be generated by converting the phase address signal in accordance with a function peculiar to each phase section and accessing a waveform memory with the converted address signal.

45 Claims, 13 Drawing Sheets

SIMPLE MIXING MODE: MIX

FM DELAY
KEY-ON MODE: FMD

PCM DELAY
KEY-ON MODE: PCMD

FM DELAY KEY-ON
& CROSSFADE MODE: FMDX

PCM DELAY KEY-ON
& CROSSFADE MODE: PCMDX

TONE COLOR INFORMATION (ONE TONE COLOR)

| | |
|---|---|
| TONE GENERATION MODE DATA | (MIX, FMD, PCMD, FMDX, PCMDX) |
| DELAY RATE DATA | (DRATE) |
| CROSSFADE RATE DATA | (XRATE) |
| DELAY RATE KEY SCALING DATA | (DKSD) |
| CROSSFADE RATE KEY SCALING DATA | (XKSD) |
| TONE COLOR PARAMETERS FOR PCM SYSTEM : START ADDRESS DATA (SAD), REPEAT ADDRESS DATA (RAD), END ADDRESS DATA (EAD), ENVELOPE PARAMETER DATA (PENV) | |
| TONE COLOR PARAMETERS FOR FM SYSTEM : ALGORITHM & PARAMETER DATA (FMP) ENVELOPE PARAMETER DATA (FENV) | |

FIG. 3

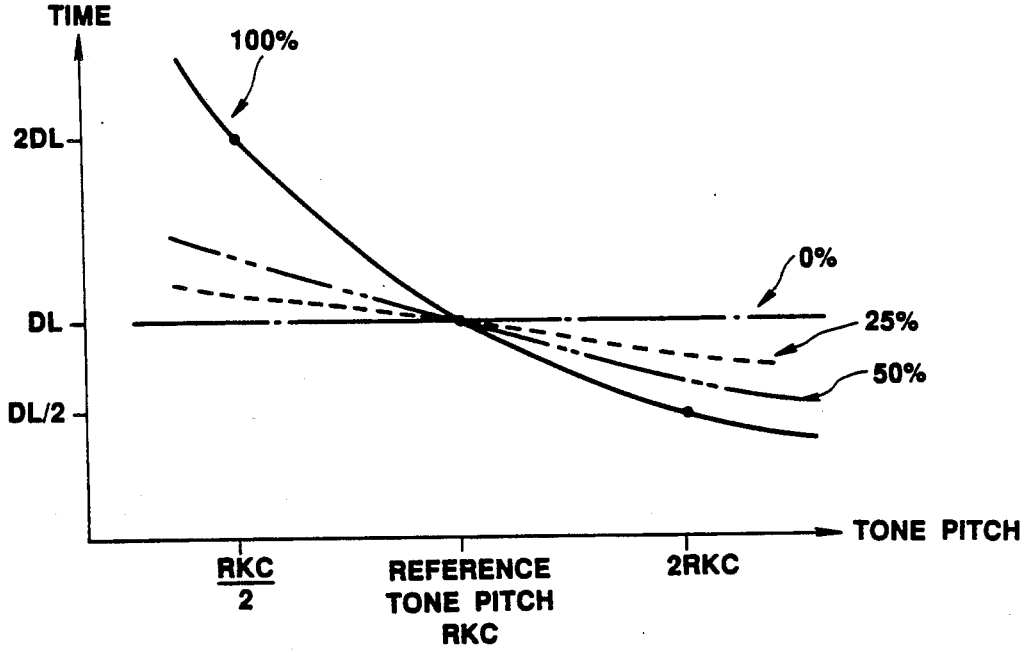

FIG. 4

TONE SIGNAL GENERATION CIRCUIT (PCM SYSTEM)

STATE CONTROL SECTION 30

TONE SIGNAL GENERATION CIRCUIT 21
(FM SYSTEM)

TIME SETTING & KEY SCALING CONTROL SECTION 29

SECOND TONE SIGNAL GENERATION CIRCUIT 214

ADDRESS CONVERSION FUNCTIONS

ENVELOPE GENERATOR 219

ELECTRONIC MUSICAL INSTRUMENT HAVING PLURAL DIFFERENT TONE GENERATORS EMPLOYING DIFFERENT TONE GENERATION TECHNIQUES

BACKGROUND OF THE INVENTION

This invention relates to an electronic musical instrument having two tone signal generation circuits of different tone signal generation systems and being capable of forming a complex tone signal by combining tone signals generated by the two tone signal generation circuits.

This invention relates also to an electronic musical instrument having a tone signal generation circuit of a pitch synchronizing type and a tone signal generation circuit of a non-pitch-synchronizing type.

This invention relates also to a tone signal synthesis device for synthesizing a tone signal by employing a frequency modulation operation or an amplitude modulation operation and, more particularly, to such device capable of controlling a relatively numerous frequency components by a simple arithmetic operation.

Japanese Patent Application Laid-Open No. 58-102296 discloses an electronic musical instrument having two tone signal generation circuits of different tone signal generation systems, causing the two tone signal generation circuits to generate tone signals corresponding to the same nominal tone color selected by a performer or by other means at a common tone pitch and combining the two tone signals. In this electronic musical instrument, the first tone signal generation circuit has a memory storing tone waveforms of plural periods corresponding to various tone colors and generates a tone signal by reading out a tone waveform of plural periods corresponding to a selected tone color. The second tone signal generation circuit generates a tone signal corresponding to the selected tone color by executing a tone signal synthesis operation of a frequency modulation type. In a rise portion of a tone in which the tone waveform changes in a complex manner, a tone signal is generated by the first tone signal generation circuit and in a succeeding portion of the tone, a tone signal is generated by the second tone signal generation circuit and a single tone signal is synthesized by combining the two tone signals.

In the prior art electronic musical instrument in which generation of a tone signal in the rise portion is merely allotted to one tone signal generation circuit and generation of a tone signal in the succeeding portion is allotted to the other tone signal generation circuit, it is difficult to control tone synthesis and, besides, a performance effect obtained is a rather monotonous one.

Further, in the prior art electronic musical instrument, the first tone signal generation circuit and the second tone signal generation circuit perform the tone signal generation operation in accordance with a common sampling frequency and perform addition and synthesis of the two output tone signals at a common sampling clock timing. In this case, the first and second tone signal generation circuits respectively generate tone signals in accordance with a sampling frequency which is not synchronous with pitches of the tone signals. Particularly, in the second tone signal generation circuit which generates a tone signal by the tone synthesis operation of a frequency modulation type, it is difficult to adopt a circuit design in which a tone signal is generated in accordance with a sampling frequency which is synchronous with the pitch. This is because, in a tone signal generation circuit of a modulation operation type generally, it is difficult or cumbersome to adopt a circuit design in which a tone signal is generated in accordance with a sampling frequency which is synchronous with the pitch in executing arithmetic operation of each term of a frequency modulation operation formula on a time shared basis or generating tone signals in plural channels on a time shard basis, for there is limit in increasing the rate of the operation timing clock. For this reason, the first tone signal generation circuit also is obliged to have a circuit design in which a tone signal is generated in accordance with a sampling frequency which is not synchronous with the pitch.

However, in a case where a tone signal is generated in accordance with a sampling frequency which is not synchronous with the pitch, there arises, as is well known, the problem of occurrence of an aliasing noise which is not harmonic with the pitch of a generated tone.

Further, since in the prior art electronic musical instrument, output tone signals of the first and second tone signal generation circuits are used only for combination for synthesis of a single tone, it can hardly be said that the two tone signal generation circuits are fully utilized.

Known in the art is a technique for synthesizing a tone signal having a desired harmonic structure by a frequency modulation operation in an audio frequency range. In this prior art tone synthesis technique, a simple single-term frequency modulation operation is insufficient for synthesizing a tone of a satisfactory tone color having sufficient harmonic components and, for this purpose, a frequency modulation operation of a multiplex term or multiple terms must be executed. This requires a complex and bulky operation circuit and, in a system in which operation of each operation term is executed on a time shared basis, increase in the rate of a control clock with resulting increase in the manufacturing cost.

As a method for synthesizing a tone containing abundant harmonic components by a relatively simple operation, there has been proposed a method using a waveform having abundant frequency components as a modulating wave or a modulated wave. Since, however, a waveform which can be used for the operation is limited to one stored in a memory, there is limit to a tone color which can be synthesized.

For solving the above described problem, U.S. Pat. No. 4,766,795 discloses a technique according to which waveform data is stored in a logarithmic expression in a waveform table used for generation of a modulating or modulated wave and the waveform data in the logarithmic expression read from this table is multiplied with a coefficient whereby a complex waveform function is obtained by converting the waveform data in the logarithmic expression which is result of the multiplication to data in a linear expression. According to this technique, a modulating wave function or a modulated wave function can be easily converted to a complex function which is different from the function stored in the waveform table so that a tone signal containing abundant frequency components can be synthesized by a modulating operation with a relatively simple construction.

In the technique disclosed in the U.S. Patent, however, there is the problem that the technique can be applied to a case where waveform data is stored in a logarithmic expression in a waveform table but it cannot be applied to a case where waveform data is stored in a linear expression in the waveform table. Further, in a case where waveform data is stored in a logarithmic expression in a waveform table, a logarithm-linear conversion circuit is required in a posterior stage of the circuit.

SUMMARY OF THE INVENTION

It is, therefore, an object of the invention to provide an electronic musical instrument of a type synthesizing a tone by combining output tone signals of plural tone signal generators of different tone signal generation systems which is capable of performing variety of controls and obtaining rich performance effects in synthesizing a tone.

More specifically, it is an object of the invention to provide an electronic musical instrument in which a delay duet effect, i.e., an effect in which start of generation of a tone signal in one of first and second tone signal generators is delayed from that in the other tone signal generator, can be realized and a key scaling control according to which the delay time of the delay duet effect is variably controlled in accordance with a tone pitch of a tone to be generated can be achieved.

It is another object of the invention to provide an electronic musical instrument in which a crossfade control, i.e., a control in which a tone signal is first generated in one of first and second tone signal generators and then generation of a tone signal is switched to the other tone signal generator and a preceding tone is gradually attenuated while a succeeding tone is caused to rise gradually during a switching period, is performed and a key scaling control for variably controlling time of the switching period in accordance with a tone pitch of a tone to be generated is performed.

It is another object of the invention to provide an electronic musical instrument which, in combining output tone signals of the first and second tone signal generators, can select a tone generation mode designating a combination as desired.

It is another object of the invention to provide an electronic musical instrument in which a crossfade control, i.e., a control in which a tone signal is first generated in one of first and second tone signal generators and then generation of a tone signal is switched to the other tone signal generator and a preceding tone is gradually attenuated while a succeeding tone is caused to rise gradually during a switching period, is performed and a control for variably controlling time of the switching period is performed.

It is another object of the invention to provide an electronic musical instrument capable of variably controlling delay time from start of generation of the preceding tone signal till start of generation of the succeeding tone.

It is another object of the invention to provide an electronic musical instrument capable of realizing a delay duet effect, i.e., an effect of delaying the start of generation of a tone signal in one of the first and second tone signal generators from that in the other tone signal generator.

It is another object of the invention to provide an electronic musical instrument capable of variably controlling delay time of the start of generation.

It is another object of the invention to provide an electronic musical instrument capable of properly supplying a key-on pulse designating start of tone generation to the first and second tone signal generators.

It is another object of the invention to enable an electronic musical instrument having two tone signal generators to adopt a tone signal generator which can generate a tone signal in accordance with a sampling frequency which is synchronized with the pitch of a tone signal to be generated.

It is another object of the invention to enable an electronic musical instrument having two tone signal generators to utilize these tone signal generators fully effectively.

It is still another object of the invention to provide a tone signal synthesis device which, in a case where a waveform table storing waveform data in a linear expression is used as a waveform table for generating a modulating or modulated wave function, can convert, with a relatively simple construction, a modulating or modulated wave function used in the modulation operation to a complex one which is different from a function stored in the waveform table whereby a tone signal containing abundant frequency components can be synthesized by a modulation operation with a relatively simple construction.

For achieving one of the above described objects of the invention, an electronic musical instrument according to the invention comprises a tone pitch designation device for designating a tone pitch of a tone to be generated, first tone signal generators for generating a tone signal having a pitch corresponding to the tone pitch designated by said tone pitch designation device, second tone signal generators for generating a tone signal having a pitch corresponding to the tone pitch designated by said tone pitch designation device in accordance with a tone signal generation system which is different from a tone signal generation system of said first tone signal generator, a delay circuit for delaying start of generation of a tone signal in one of said first and second tone signal generators with respect to start of generation of a tone signal in the other tone signal generator, and a key scaling circuit for variably controlling delay time in said delay circuit in accordance with the tone pitch of a tone to be generated.

Tone signals corresponding to a common designated tone pitch are generated in the first and second tone signal generators whereby a duet effect can be realized. In this case, a delay duet effect can be realized by delaying start of generation of a tone signal in one of the first and second tone signal generators from start of generation of a tone signal in the other tone signal generator by the delay circuit. Control of the delay time corresponding to the tone pitch can be performed by variably controlling the delay time in the delay circuit by the key scaling circuit. By these arrangements, various controls including equalizing of the impression of delay in accordance with the tone pitch and, conversely, differing of the impression of delay greatly in accordance with the tone pitch can be performed.

The key scaling circuit may be omitted. Also, the key scaling circuit may be substituted by a time control circuit for variably controlling the delay time in the delay circuit.

For achieving one of the objects of the invention, an electronic musical instrument according to the invention comprises a tone pitch designation device for designating a tone pitch of a tone to be generated, a first tone signal generator for generating a tone signal having a pitch corresponding to the tone pitch designated by said tone pitch designation device, a second tone signal generator for generating a tone signal having a pitch corresponding to the tone pitch designated by said tone pitch designation device in accordance with a tone signal generation system which is different from a tone signal generation system of said first tone signal generator, a crossfade control circuit for performing a control in which a tone signal is first generated in one of said first and second tone signal generators and then generation of a tone signal is switched to the other tone signal generator and a preceding tone is gradually attenuated while a succeeding tone is caused to rise gradually during the switching period, and a key scaling circuit for variably controlling time length of said switching period in said crossfade control circuit in accordance with the tone pitch of a tone to be generated.

By generating a tone signal first in one of the first and second tone signal generators and then switching tone generation to the other tone signal generator, tone generation can be shared by the two tone signal generators in accordance with a tone generation stage. In this case, by performing the crossfade control in which the preceding tone is gradually attenuated while the succeeding tone is caused to rise gradually during the switching period, a smooth switching of the tone signal can be achieved. According to the invention, the key scaling control for variably controlling the time of the switching period in the crossfade control, i.e., crossfade time, in accordance with the tone pitch of a tone to be generated is performed. By these arrangements, various controls including equalizing of the impression of switching of a tone signal in accordance with the tone pitch and, conversely, differring the impression of switching greatly in accordance with the tone pitch can be performed.

A time control circuit for variably controlling time of the switching period may be provided without providing the key scaling circuit. By doing so, if, for example, the switching period is shortened, switching is made quickly and it will give a strong impression that the tone generation stage is shared by the two systems whereas if the switching period is prolonged, switching is made slowly and it will give a strong impression that tone signals of the two systems are overlapped so that a duet is performed in a part of the tone generation stage. Thus, by the variable control of the switching period, various performance effects can be obtained.

An arrangement may be made so that the time control circuit variably controls the time of the switching period and the delay time from start of generation of the preceding tone till start of generation of the succeeding tone independently from each other. By doing so, timepoint of starting the switching period, i.e., the crossfade time, may be controlled as desired whereby further various performance effects can be obtained.

For achieving one of the objects of the invention, an electronic musical instrument according to the invention comprises a tone pitch designation device for generating tone pitch designation information designating a tone pitch of a tone to be generated, a first tone signal generator for generating a tone signal having a pitch which is determined by said tone pitch designation information in accordance with an effective sampling frequency which is synchronized with said pitch and outputting the tone signal at a sampling timing based on a common first sampling frequency, a second tone signal generator for generating a tone signal having a pitch which is determined by said tone pitch designation information and outputting the tone signal at a second sampling frequency which is asynchronous with this pitch, said first and second sampling frequencies being in an integer multiple relation to each other, a digital addition circuit for adding the output tone signals of said first and second tone signal generators together, and a digital-to-analog conversion circuit for converting an output tone signal of said digital addition circuit to an analog signal.

In the first tone signal generator, a tone signal is generated in accordance with an effectively sampling frequency which is synchronized with its pitch and is delivered out at a sampling frequency in accordance with the first sampling frequency. By this arrangement, the problem of occurrence of an aliasing noise in the tone signal generated in the first tone signal generator can be solved.

Since the first sampling frequency and the second sampling frequency are in multiple integer relation, when the output tone signals of the first and second tone signal generators are added together by the digital addition circuit, the two tone signals can be added without causing a problem at a harmonized timing. Alternatively stated, by establishing such integer multiple relation between the first sampling frequency and the second sampling frequency, the first tone signal generator can be formed as a tone signal generator of a pitch synchronizing type even if the second tone signal generator is one of a non-pitch-synchronizing type and, besides, the output tone signals of the two tone signal generation circuits can be added and synthesized without causing a trouble at a harmonized timing.

By generating tone signals corresponding to a common tone pitch by the first and second tone signal generators respectively (with a suitable pitch difference if necessary) and combining and synthesizing these tone signals by sharing the rise portion and succeeding portion by these tone signal generators, an optimum tone synthesis corresponding to the tone generation stage can be effectively obtained.

By generating tone signals at a common tone pitch (with a suitable pitch difference if necessary) by the first and second tone signal generators and suitably combining and synthesizing these tone signals during the entire tone generation period, a duet effect can be effectively obtained.

For achieving one of the objects of the invention, an electronic musical instrument of the invention comprises a tone pitch designation device for designating a tone pitch of a tone to be generated, a first tone signal generator for generating a tone signal having a pitch determined by supplied tone pitch designation information in accordance with an effective sampling frequency synchronized with the pitch and outputting the tone signal at a sampling timing based on a common first sampling frequency, a second tone signal generator for generating a tone signal having a pitch determined by supplied tone pitch designation information and outputting the tone signal at a second sampling frequency which is not synchronized with this pitch, a mode selector for selecting a mode and a supply control circuit for performing, in accordance with a mode selected by said mode selector, a control for supplying the tone pitch designation information representing a tone pitch designated by said tone pitch designation device to at least one of said first and second tone signal generators, a control for generating a tone signal of the same designated tone pitch in at least one of said first and second tone signal generators being made in accordance with the mode selected by said mode selector.

By providing the mode selector and the supply control circuit, an effective utilization of the first and second tone signal generators can be realized. When a mode in which tone signals of the same designated tone pitch has been selected in the first and second tone signal generators, an optimum tone synthesis effect corresponding to the duet effect and tone generation stage can be obtained as described above. When a mode in which a tone signal of the designated tone pitch is generated in one of the first and second tone signal generators has been selected, the first tone signal generator and the second tone signal generator can be used for generation of tone signals of different tone pitches whereby the number of tones which can be sounded simultaneously can be increased. Thus, a further effective utilization of the first tone signal generator and the second tone signal generator can be realized.

For achieving one of the objects of the invention, a tone signal synthesizing device for synthesizing a tone signal by a modulation operation using a modulating wave signal and a modulated wave signal comprises a waveform table storing waveform data of a waveform of a predetermined waveform function in linear expression, a phase address signal supply circuit for supplying a phase address signal for a modulating wave signal or a modulated wave signal, an address conversion circuit for converting an address value of said phase address signal for each of phase sections provided by dividing a phase of one cycle into plural sections, in accordance with a function established individually for each of said phase sections, and a circuit for outputting waveform data of a waveform function which is different from said predetermined waveform function from said waveform table in response to said phase address signal by accessing said waveform table with the output of said address conversion circuit.

Since the address conversion circuit converts an address value of the input phase address signal for each of phase sections in accordance with a function established individually for each of the phase sections, the input phase address signal becomes converted in a non-linear characteristic as viewed over one cycle as a whole (i.e., a non-linear characteristic is realized over one cycle as a whole). Since the waveform table is accessed by the converted address signal, the relation between the input phase address signal and the address with which the waveform table is accessed becomes non-linear and, as a result, waveform data of a function which is different from the predetermined waveform function stored in the waveform table is provided from the waveform table in response to the phase address signal.

For example, even if a monotonous sine wave function is stored in the waveform table, waveform data simulating a $\sin^2$ wave function can be obtained from the waveform table by suitably establishing the address conversion function for each phase section. Further, the address conversion function for each phase section can be established suitably so that a suitable function can be obtained by simulation.

For achieving one of the objects of the invention, an electronic musical instrument of the invention comprises a tone pitch designation device for designating a tone pitch of a tone to be generated, a first tone signal generator for generating a tone signal having a pitch corresponding to the tone pitch designated by said tone pitch designation device, a second tone signal generator for generating a tone signal having a pitch corresponding to the tone pitch designated by said tone pitch designation device in accordance with a tone signal generation system which is different from a tone signal generation system of said first tone signal generator, a tone generation mode selector for selecting a tone generation mode designating a combination of tone generation in said first and second tone signal generators from among a plurality of different tone generation modes, and a control circuit for controlling tone generation in said first and second tone signal generators in accordance with the tone generation mode selected by said mode selector.

A tone selection mode for designating a combination of tone generation in the first and second tone signal generators is selected from among plural tone generation modes. In accordance with the selected tone generation mode, tone generation in the first and second tone signal generators is respectively controlled. By this arrangement, the manner of combination of the tone generation in the first and second tone signal generators is switched as desired in accordance with selection of the tone generation mode. Accordingly, various controls can be made in tone synthesis and rich performance effect can be obtained.

For example, in accordance with tone color selection, a tone generation mode determined by the selected tone color may be automatically selected. In this case, an optimum tone generation mode corresponding to the tone color is selected whereby not only establishment of a tone color of a tone generated in the respective tone signal generators but also the manner of combination of tone generation in the two systems become suited to the tone color and tone quality of a finally synthesized tone signal improves.

For achieving one of the objects of the invention, an electronic musical instrument of the invention comprises a tone pitch designation device, first and second tone generators having different tone generation systems, a circuit for generating a key-on pulse designating start of tone generation in response to designation of a tone pitch in the tone pitch designation device and a key-on pulse distribution circuit for distributing this key-on pulse to both or either of the first and second tone signal generators to start generation of a tone signal in the tone signal generator to which the key-on pulse has been designated.

Upon distribution of the key-on pulse to both or either of the first and second tone signal generators by the key-on pulse distribution circuit, generation of a tone signal is started in the tone signal generator to which the key-on pulse has been distributed. In case tone generation is started simultaneously in the two tone signal generators, timings of start of tone generation in the two tone signal generators can be synchronized with each other so that occurrence of phase difference can be prevented.

Embodiments of the invention will now be described with reference to the accompanying drawings.

BRIEF DESCRIPTION OF THE DRAWINGS

In the accompanying drawings,

FIG. 3 is a diagram for showing, by way of example, contents of various tone color information corresponding to one tone color in the same embodiment;

FIG. 4 is a graph showing, by way of example, a key scaling characteristic of delay time or crossfade time;

FIGS. 19*a* and 19*b* are waveform diagrams showing an example of waveforms produced from the waveform table in FIG. 16 in which FIG. 19*a* shows a case where the address conversion is not made by the address conversion section and FIG. 19*b* shows a case where the address conversion is made by the address conversion section;

DESCRIPTION OF PREFERRED EMBODIMENTS

Description of the Entire Construction

Figure 1:
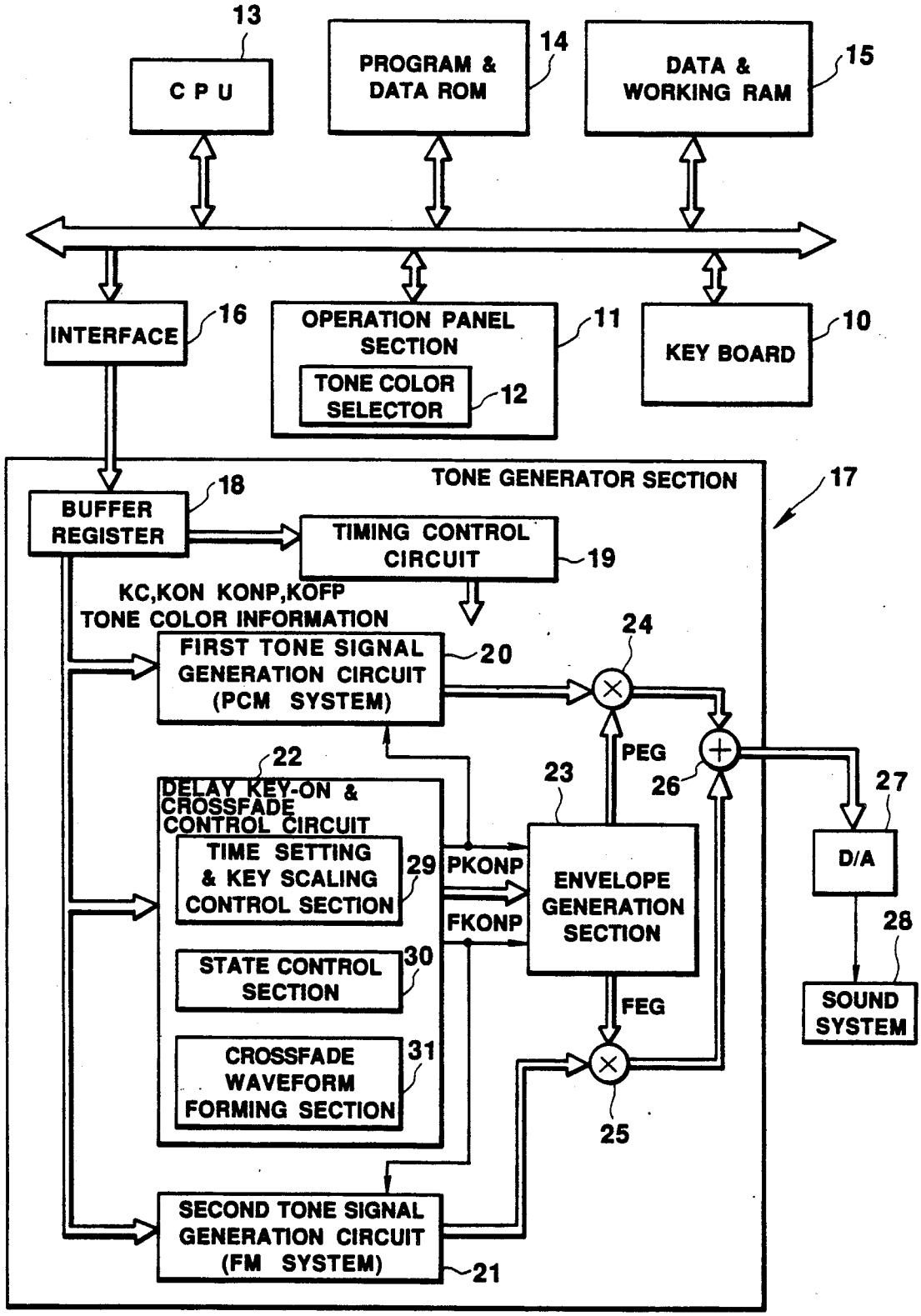
FIG. 1 is a block diagram showing schematically the entire structure of an embodiment of the invention.

Referring to FIG. 1, a keyboard 10 has keys for designating tone pitches of tones to be generated and includes a key switch circuit consisting of key switches corresponding to the respective keys. An operation panel section 11 includes a tone color selector 12 for selecting and controlling a tone color for a tone to be generated and also various operators such as an operator for setting and controlling a tone volume and an operator for selecting a tonal effect. In this embodiment, various processings including a scanning processing for detecting depressed and released keys in the keyboard 10, a scanning processing for detecting on-off operations of the various operators, switches and selector in the operation panel section 11 and a key assigning processing are executed in accordance with a softwear program by a microcomputer. A microcomputer section includes a CPU (central processing unit) 13, a program and data ROM (read-only memory) 14 and a data and working RAM (random-access memory) 15.

Various data obtained as results of the key assigning processing for depressed keys and the detection processing for detecting the on-off operations of the operators and switches and selector in the operation panel section 11 are supplied to a tone generator section 17 through an interface 16. By way of example, data supplied to the tone generator section 17 through the interface 16 include key codes KC representing keys assigned to respective tone generation channels, a key-on signal KON representing whether or not depression of each of these keys is sustained, a key-on pulse KONP corresponding to rise (start of depression of the key) of the key-on signal KON, a key-off pulse KOFP corresponding to fall of the key-on signal KON (release of the key) and various tone color information for realizing a selected tone color.

The tone generator section 17 includes a buffer register 18 for temporarily loading various data supplied through the interface 16, a timing control circuit 19 for generating timing signals and clock pulses for controlling various operations, tone signal generation circuits 20 and 21 having tone signal generation systems which are different from each other, a delay key-on and crossfade control circuit 22, an envelope generation section 23, multipliers 24 and 25 for imparting envelopes and an adder 26 for adding output tone signals of the tone signal generation circuits 20 and 21 supplied through the multipliers 24 and 25 together. The output of the adder 26 is converted to an analog signal by a digital-to-analog converter 27 and supplied thereafter to a sound system 28.

The first and second tone signal generation circuits 20 and 21 generate, in digital, tone signals having pitches corresponding to the key codes KC supplied through the buffer register 18 with tone colors corresponding to tone color information. The tone signal generation circuits generate tone signals which are nominally of a common tone color but actual tone color may somewhat differ from each other depending upon difference in the tone signal generation system of the two circuits 20 and 21. Further, there may be some difference between the two circuits 20 and 21 in presence or absence of timewise change in the tone color and mode of timewise change. In any case, the tone quality of a generated tone is somewhat different between the two tone signal generation circuits 20 and 21. The tone signal generation circuits 20 and 21 generate tone signals having a pitch corresponding to a common designated pitch corresponding to the key code KC. If necessary, however, suitable pitch difference or tone pitch shift or scale shift may be applied between the two tone signal generation circuits 20 and 21. For example, controls such as tuning, transposition, vibrato, glide and pitch control are performed independently in the respective tone signal generation circuits 20 and 21.

For example, the tone signal generation system in the first tone signal generation circuit 20 comprises memory means prestoring waveform data of plural tone waveforms corresponding to various tone colors, has waveform data of a tone waveform corresponding to a selected tone color read out from this memory means and generates a tone signal on the basis of the read out waveform data. For the sake of convenience, this system will be referred to as "PCM system". The tone signal generation system in the second tone signal generation circuit 21 generates a tone signal by carrying out a tone synthesis operation of the frequency modulation type and this system will be referred to as "FM system".

The delay key-on and crossfade control circuit 22 performs, when a tone synthesis is made by combining tone signals generated by the tone signal generation circuits 20 and 21, a "delay key-on" control and a "crossfade" contro in accordance with a mode of combination.

The term "delay key-on" means delaying of start of generation of a tone signal in one of the first and second tone signal generation circuits 20 and 21 with respect to start of generation of a tone signal in the other circuit to realize a delayed duet effect in a case where a duet effect is produced by generating tone signals corresponding to a designated tone pitch by the first and second tone signal generation circuits 20 and 21.

The term "crossfade" means a control which, when a tone signal is first generated in one of the first and second tone signal generation circuits 20 and 21 and then generation of a tone signal is switched to the other circuit, causes the preceding tone signal to attenuate gradually and the succeeding tone signal to rise gradually during the switching period. By performing this "crossfade" in combination with "delay key-on", i.e., performing a desired "crossfade" after "delay key-on", switching of a tone signal can be made smoothly in a desired tone generation stage.

Dividing circuit elements of the delay key-on and crossfade control circuit 22 by their function, the delay key-on and crossfade control circuit 22 consists of a time setting and key scaling control section 29 for establishing and controlling a delay time in the "delay key-on" and time length in the switching period in the "crossfade" (this time length will be hereinafter called "crossfade time") and performing a key scaling control for variably controlling these time periods in accordance with the tone pitch of a generated tone, a state control section 30 for controlling states of the delay key-on and crossfade controls, and a crossfade waveform forming section 31 for forming a weighting waveform for crossfading.

In the embodiment described below, the functions of the time setting and key scaling control section 29 is realized by sharing a part of hardware of the first tone signal generation circuit 20. More specifically, a time counting hardware circuit in the time setting and key scaling control section 29 is used commonly as a phase address counting hardware circuit in the first tone signal generation circuit 20.

The envelope generation section 23 generates envelope signals PEG and FEG for establishing envelopes of tone signals produced by the tone signal generation circuits 20 and 21. These envelope signals PEG and FEG are formed by weighting normal envelope signals generated in response to depression and release of keys with the weighting waveform for crossfading generated by the crossfade waveform forming section 31 in the delay key-on and crossfade control circuit 22.

Description About the Tone Generation Mode

There are, for example, the following five combination modes, i.e., tone generation modes, for effecting tone synthesis by combining tone signals produced by the first and second tone signal generation circuits 20 and 21. For helping understanding, typical examples of the envelope signals PEG and FEG of the tone signal generation circuits 20 and 21 in the respective tone generation modes are shown in FIG. 2. Tone signals from the tone signal generation circuits 20 and 21 are mixed together in a ratio corresponding to the shapes of the envelope signals PEG and FEG.

1) Simple mixing mode (FIG. *2a*)

The simple mixing mode is a mode in which tone signals are produced simultaneously in the PCM system tone signal generation circuit 20 and the FM system tone signal generation circuit 21. An ordinary duet effect is realized in this mode. This mode is abbreviated as MIX.

2) FM delay key-on mode (FIG. *2b*)

The FM delay key-on mode is a mode in which a tone generation is started first in the PCM system tone signal generation circuit 20 and started with a delay in the FM system tone signal generation circuit 21 and thereafter tone generation is performed concurrently in the two circuits 20 and 21. In this mode, a delayed duet effect is realized. The delay time can be variably controlled. This mode is abbreviated as FMD.

3) PCM delay key-on mode (FIG. *2c*)

The PCM delay key-on mode is a mode in which tone generation is started first in the FM system tone signal generation circuit 21 and started with a delay in the PCM tone signal generation circuit 20 and thereafter tone generation is performed concurrently in the two circuits 20 and 21. In this mode, a delayed duet effect is realized. The delay time can be variably controlled. This mode is abbreviated as PCMD.

4) FM delay key-on and crossfade mode (FIG. *2d*)

In this mode, tone generation is started first in the PCM system tone signal generation circuit 20 and started with a delay in the FM system tone signal generation circuit 21 and, besides, the tone signal of the succeeding FM system tone signal generation circuit 21 is controlled so as to rise gradually whereas the tone signal of the preceding PCM system tone signal generation circuit 20 is controlled so as to attenuate gradually. By this arrangement, an effect for switching tone generation can be realized. The delay time and the switching period, i.e., crossfade time, can be variably controlled. This mode is abbreviated as FMDX.

5) PCM delay key-on and crossfade mode (FIG. *2e*)

In this mode, tone generation is started first in the FM system tone signal generation circuit 21 and started with a delay in the PCM system tone signal generation circuit 20 and, besides, the succeeding tone signal of the PCM system tone signal generation circuit 20 is controlled so as to rise gradually whereas the preceding tone signal of the FM system tone signal generation circuit 21 is controlled so as to attenuate gradually. By this arrangement, an effect for switching tone generation can be realized. The delay time and the switching period, i.e., crossfade time, can be variably controlled. This mode is abbreviated as PCMDX.

Description About Tone Color Information

An example of tone color information corresponding to a selected tone color is shown in FIG. 3. Such tone color information is stored, for example, in the data ROM 14 for each tone color. Tone color information corresponding to a tone color selected by the tone color selector 12 is read out from the ROM 14 and supplied to the tone generator section 17. Description will now be made about data contained in tone color information corresponding to one tone color.

Tone generation mode data is data for designating the tone generation mode and designates one of the above described five modes MIX through PCMDX.

Delay rate data DRATE is data for setting delay time in the "delay key-on" control.

Crossfade rate data XRATE is data for setting crossfade time in the "crossfade" control.

Delay rate key scaling data DKSD is data for designating key scaling characteristics in variably controlling delay time in the "delay key-on" control in accordance with the tone pitch (i.e., key scaling control).

Crossfade rate key scaling data XKSD is data for designating key scaling characteristics in variably controlling crossfade time in the "crossfade" control in accordance with the tone pitch.

For example, four types of key scaling characteristics, i.e., "0%", "25%", "50%" and "100%", are provided. Key scaling data DKSD and XKSD respectively designate one of these characteristics.

As a tone source in the PCM system tone signal generation circuit 20, a waveform memory prestoring waveform data of plural tone waveforms corresponding to various tone colors is employed. By way of example, waveforms of plural periods of a rise portion of a tone and waveforms of plural periods of a sustain portion of the tone are stored at continuous addresses of the memory.

In tone color parameters for the PCM system tone signal generation circuit 20, start address data SAD is data indicating the first address of the waveforms of plural periods of the rise portion of a tone. Repeat address data RAD is data indicating the first address of the waveforms of plural periods of the sustain portion of the tone. End address data EAD is data indicating the last address of the waveforms of the plural periods of the sustain portion. For producing a tone signal in the PCM system tone signal generation circuit 20, the waveforms of plural periods of the rise portion of the tone starting from the start address is read out once and, thereafter, the waveforms of plural periods of the sustain portion stored between the repeat address and the end address are read out repeatedly.

In tone color parameters for the FM system tone signal generation circuit 21, algorithm and parameter data FMP include data designating operation algorithm for the tone synthesis frequency modulation operation and operation parameter data such as modulation index.

Envelope parameter data PENV and FENV are data for respectively establishing characteristics of envelope shape signals in the tone signal generation circuits 20 and 21.

Description About Key Scaling Characteristics

FIG. 4 shows an example of the four types key scaling characteristics "0%", "25%", "50%" and "100%". The horizontal axis represents tone pitch and the vertical axis represents time. Time DL is time determined by the delay rate data DRATE or the crossfade rate data XRATE itself, representing time during which no scaling is made.

"0%" designates characteristics according to which time is DL for all tone pitches, i.e., key scaling is not made.

"100%" designates characteristics according to which a key scaling of time which is double or half with respect to one octave (i.e., key scaling characteristic according to which time becomes half when the octave is raised by one octave and time becomes double when the octave is lowered by one octave).

"50%" designates key scaling characteristics which represent inclination of about half of the inclination of the key scaling characteristics of "100%".

"25%" is key scaling characteristics which represent inclination of about ¼ of the inclination of the key scaling characteristics of "100%".

A predetermined tone pitch is employed as a reference tone pitch RKC. At this reference tone pitch RKC, the respective key scaling characteristics are determined in such a manner that, as shown in the figure, scaling is zero, i.e., the time DL which is determined by the delay rate data DRATE or crossfade rade data XRATE itself and during which no scaling is made, for all key scaling characteristics.

The PCM system tone signal generation circuit 20

Figure 5:
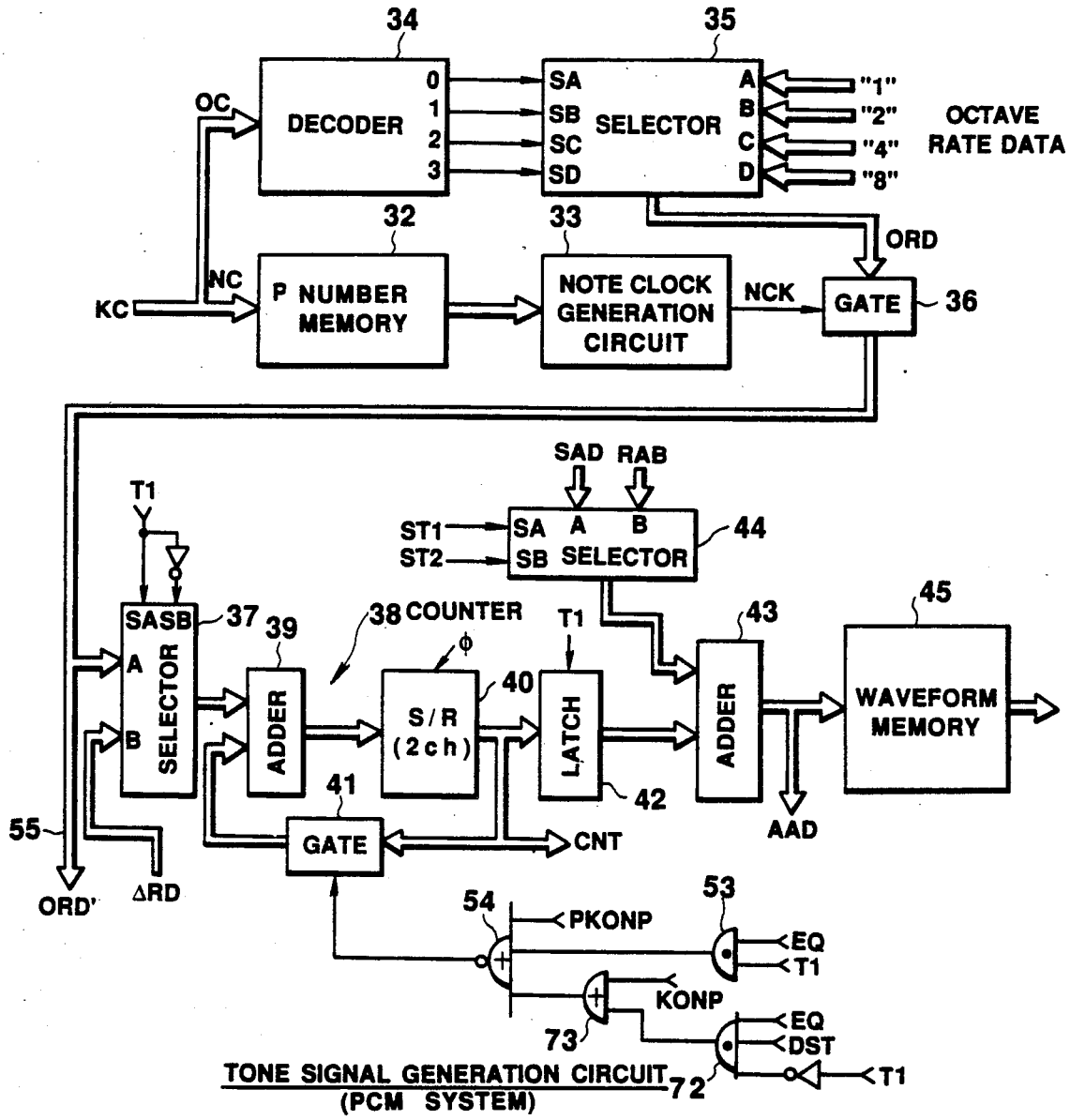
FIG. 5 is a block diagram showing a specific example of the first tone signal generation circuit (PCM system) in FIG. 1.

FIG. 5 shows a specific example of the PCM system tone signal generation circuit 20. For brevity of explanation, description will be made about an example in which the number of tone generation channel is one.

In the PCM system tone signal generation circuit 20 of FIG. 5, a pitch synchronizing system in which the pitch of a tone to be generated is synchronized with the sampling frequency is adopted. In this example, for performing tone signal synthesis of the pitch synchronizing system, information called "P number" is used by way of example. The "P number" is a number indicating the sample point number during one period of a tone waveform having tone frequency to be achieved.

A P number memory 32 prestores "P numbers" corresponding to twelve notes in a predetermined reference octave. A note code NC representing the note name in the key code KC supplied from the buffer register 18 is supplied to the P number memory 32 and a P number corresponding to the note code NC is read out. A note clock generation circuit 33 receives the P number from the P number memory 32 and performs a frequency dividing operation in accordance with this P number and thereby produces a note clock pulse NCK corresponding to the note name of the tone to be generated.

An octave code OC representing octave in the key code KC is applied to a decoder 34 and decoded by each octave. The output of the decoder 34 is applied to selection control inputs SA to SD of a selector 35 for selecting octave data "1", "2", "4" and "8" supplied to data inputs A to D of the selector 35. This octave rate data is numerical data corresponding to a frequency ratio in the octave relation and a larger value thereof corresponds to a higher octave.

Octave rate data ORD provided from the selector 35 is applied to a gate 36. This gate 36 is enabled when the note clock pulse NCK supplied from the note clock generation circuit 33 is "1" (i.e., at the time of generation of the pulse) to gate out the octave rate data ORD.

Accordingly, the octave rate data ORD consisting of numerical value corresponding to the octave of the key code KC is repeatedly gated out of the gate 36 in synchronism with the timing of generation of the note clock pulse NCK corresponding to the note name of the key code KC. By the value of this octave rate data ORD and the repeating frequency synchronized with the timing of generation of the note clock pulse NCK, a tone frequency corresponding to the tone pitch of the key code KC is established.

The octave rate data ORD gated out of the gate 36 is supplied to an adder 39 of a counter 38 through an A input of a selector 37. The selector 37 selects the A input when a timing signal T1 is "1" and selects a B input when the timing signal T1 is "0".

The counter 38 includes the adder 39, a 2-stage shift register 40 which is shift-controlled by a clock pulse $\phi$ and a gate 41. The output of the adder 39 is supplied to the shift register 40 and the output of the shift register 40 is supplied to the other input of the adder 39 through a gate 41.

Figure 6:
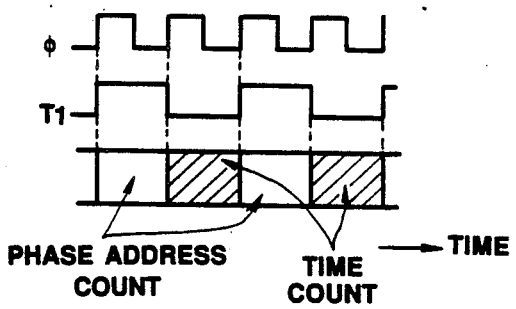
FIG. 6 is a time chart showing an example of the clock pulse and various operation timings.

As shown in FIG. 6, the clock pulse $\phi$ has a frequency which is double as high as the timing signal T1. The counter 38 performs a time sharing operation with two time slots thereby performing dual operations as a counter having different functions. More specifically, during the time slot during which the timing signal is "1", the counter 38 repeatedly adds (accumulates) the octave rate data ORD supplied through the A input of the selector 37, thus functioning as a "phase address counter". In this case, the counter 38 produces a phase address signal which changes at a rate corresponding to the tone pitch of the key code KC. During the time slot during which the timing signal T1 is "0", the counter 38 repeatedly addes (accumulates) rate data $\Delta$ RD for counting time supplied through the B input of the selector 37, thus functioning as a "time counter". As will be described later, the function of the counter 38 as the "time counter" is utilized for counting the delay time in the "delay key-on" control and counting the crossfade time in the "crossfade" control.

The output of the shift register 40 is supplied to a latch circuit 42. The latch circuit 42 latches the output of the shift register 40 when the timing signal T1 is "1". Therefore, the phase address signal generated by the counter 38 functioning as the "phase address counter" is latched by the latch circuit 42. The phase address signal latched by the latch circuit 42 is supplied to an adder 43 as a relative phase address signal.

The start address data SAD and repeat address data RAD corresponding to the selected tone color are supplied to a selector 44. The start address data SAD is initially selected by the selector 44 in response to a state signal ST1 and the start address dat SAD is supplied to an adder 43. The output of the adder 43 is applied to an address input of a waveform memory 45.

The waveform memory 45 prestores waveform data of plural tone waveforms corresponding to various tone colors, storing waveforms of plural periods of a rise portion and waveforms of plural periods of a sustain portion of one tone color at continuous addresses. Initially, by adding the relative phase address data generated by the counter 38 and the start address data SAD together, the data of waveforms of plural periods of the rise portion are sequentially read out.

The waveform data read out from the waveform memory 45 is supplied to the multiplier 24 (FIG. 1) as the output tone signal of the PCM system tone singal generation circuit 20.

On the other hand, an address signal AAD supplied from the adder 43 to the address input of the waveform memory 45 is supplied also to the state control section 30 and used therein for controlling the reading state of the waveform memory 45.

Control of the Waveform Reading State

Figure 7:
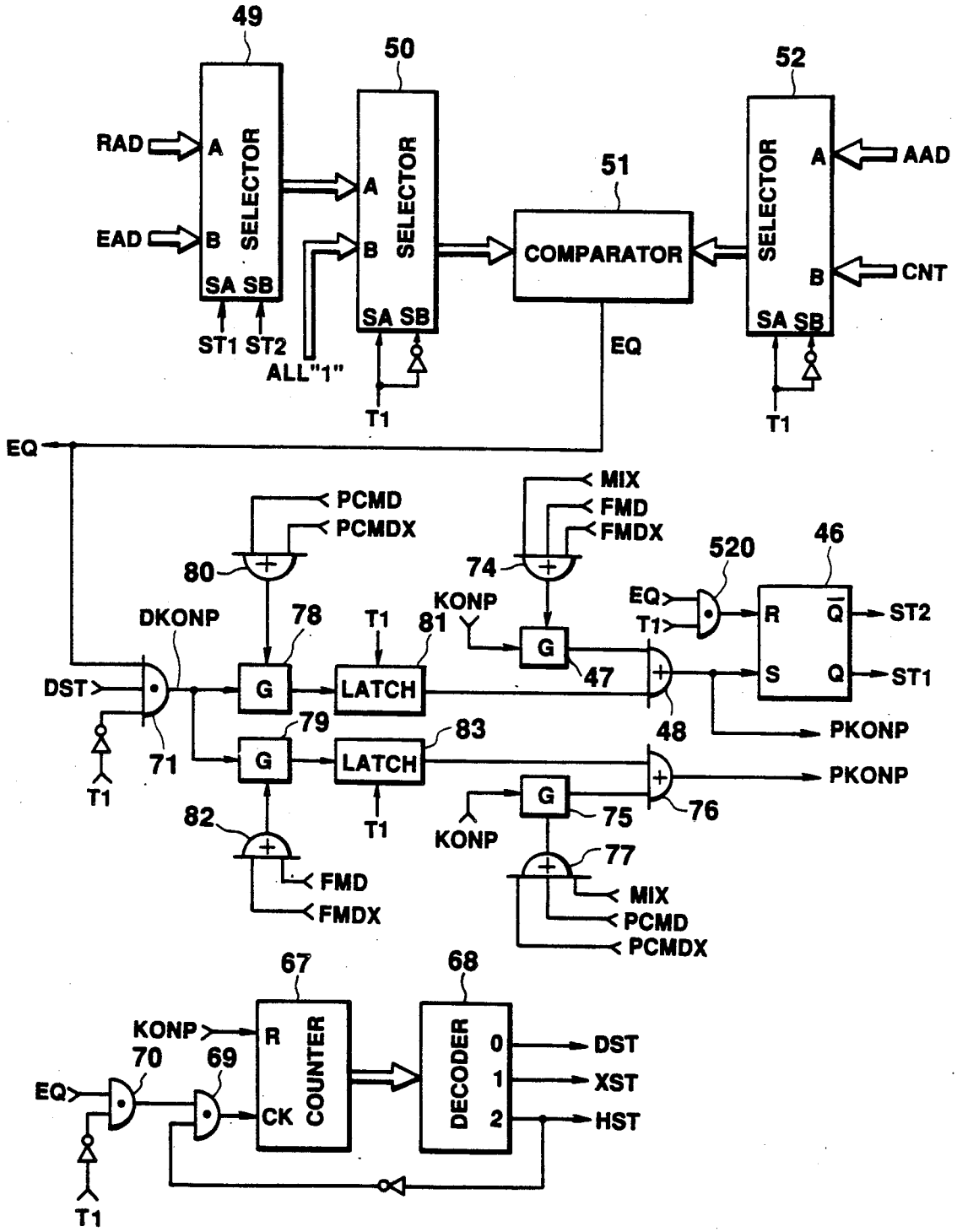
FIG. 7 is a block diagram showing a specific example of the state control section in FIG. 1.

A specific example of the state control section 30 is shown in FIG. 7.

In FIG. 7, a flip-flop 46 is provided for producing state signals ST1 and ST2 for controlling the reading state of the waveform memory 45. The key-on pulse KONP is applied to a set input S of the flip-flop 46 through a gate 47 and an OR gate 48 thereby turning its set output Q to "1" and thus turning initially the state signal ST1 to "1". In the selector 44 of FIG. 5, therefore, as described above, the start address data SAD is initially selected and the waveforms of plural periods of the rise portion are read out from the waveform memory 45.

The repeat address data RAD and the end address data EAD are supplied respectively to A and B inputs of a selector 49. The selector 49 selects the repeat address data RAD when the state signal ST1 is "1" and selects the end address data EAD when the state signal ST2 is "1". Therefore, the repeat address data RAD is initially provided from the selector 49. The output of the selector 49 is applied to a comparator 51 through an A input of a selector 50. The selector 50 selects the A input and supplies the repeat address data RAD to the comparator 51 when the timing signal T1 is "1", i.e., at a timing when the counter 38 (FIG. 5) is used for phase address counting.

To the other input of the comparator 51 is applied the output of the selector 52. The selector 52 receives at an A input thereof the address signal AAD from the adder 43 (FIG. 5) and selects the address signal AAD when the timing signal T1 is "1". In the comparator 51, therefore, the current waveform reading address and the repeat address data RAD are compared with each other when the timing signal T1 is "1", i.e., at the timing when the counter 38 (FIG. 5) is used for phase address counting. If they coincide with each other, the comparator 51 produces a signal "1" as a coincidence signal EQ. This coincidence signal EQ and the timing signal T1 are applied to an AND gate 520 and an output of the AND gate 520 is supplied to a reset input R of the flip-flop 46.

Figure 8:
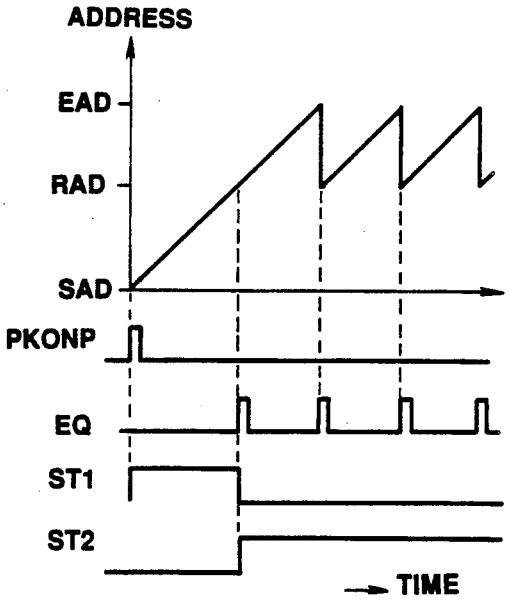
FIG. 8 is a time chart for explaining an example of waveform readout control in the first tone signal generation circuit in FIG. 1.

If, therefore, the waveform reading address has reached the address of the repeat address data RAD when the waveform of plural periods of the rise portion of a tone are being read out, i.e., when the state signal ST1 is "1", the flip-flop 46 is reset and the state signal ST2 which is a reset output of the flip-flop 46 is turned to "1" and the state signal ST1 is turned to "0" (see FIG. 8).

In the selector 44 of FIG. 5, when the state signal ST2 has been turned to "1", the repeat address data RAD is selected so that the adder 43 adds the repeat address data RAD to the relative phase address signal supplied from the latch circuit 42. On the other hand, the coincidence signal EQ and the timing signal T1 are applied to an AND gate 53 of FIG. 5 and the output of this AND gate 53 is supplied to a control input of a gate 41 of the counter 38 after being inverted by a NOR gate 54. When, therefore, absolute address data which has been added in the adder 43 as offset address data is switched to the repeat address data RAD, the gate 41 is disabled and the past relative phase address value in the counter 38 is cleared. Thereafter, the counter 38 resumes counting of the relative phase address from zero.

In response to the state signal ST2 which is "1", the selector 49 in FIG. 7 selects the end address data EAD. When, therefore, the state signal ST2 is "1", the comparator 51 compares the current waveform reading address with the end address data EAD at the phase address count timing. If they coincide with each other, the coincidence signal EQ is turned to "1" and the relative phase address count value in the counter 38 of FIG. 5 is cleared to zero.

In the foregoing manner, the waveform reading address changes repeatedly from the address corresponding to the repeat address data RAD to the end address data EAD whereby the waveform of plural periods of the sustain portion of the tone are repeatedly read out (see FIG. 8).

The Time Setting for Delay Key-On and Crossfade and the Key Scaling Control

Figure 9:
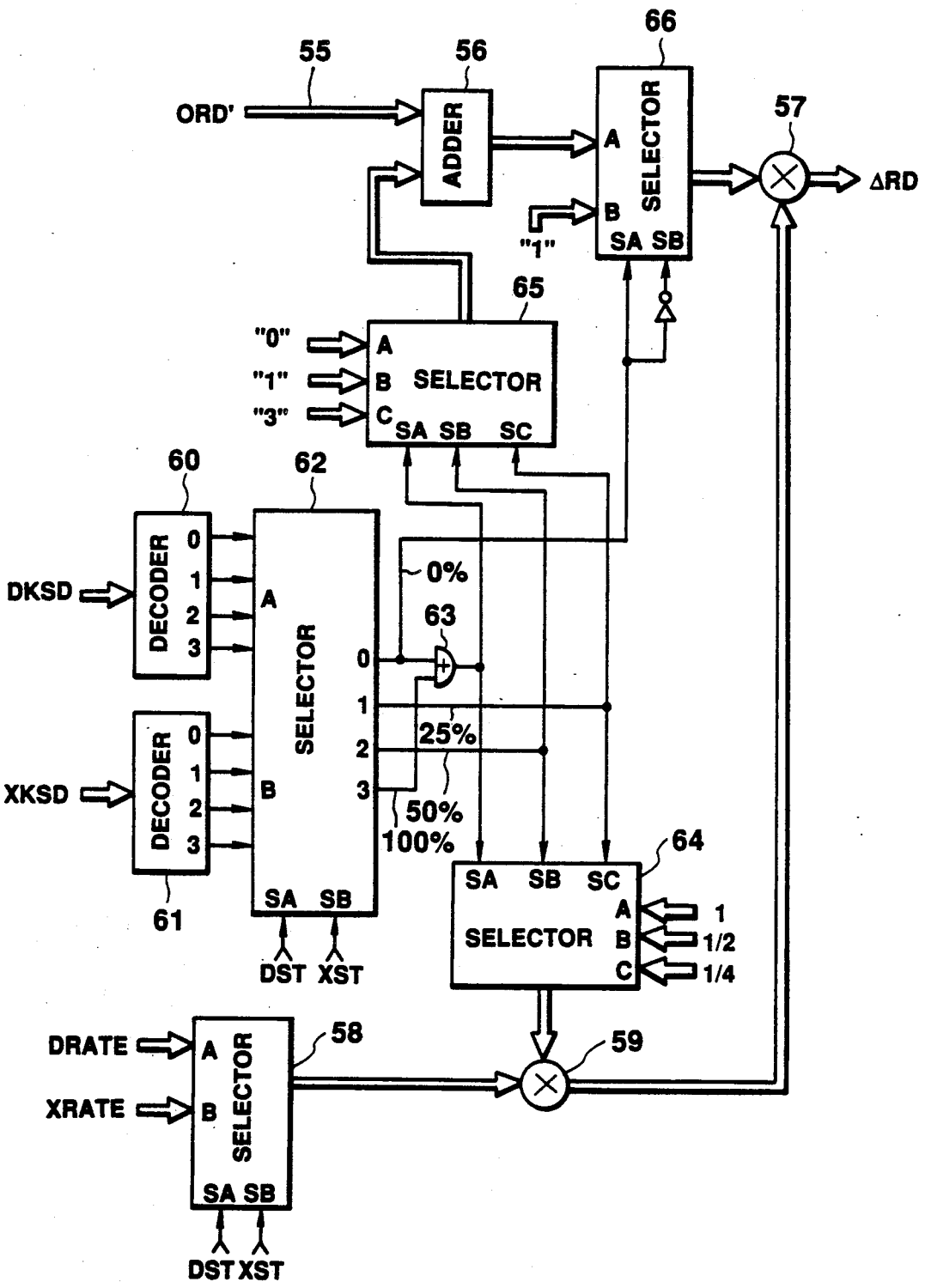
FIG. 9 is a block diagram showing a specific example of the time setting and key scaling control section in the first tone signal generation circuit.

A specific example of the time setting and key scaling control section 29 is shown in FIG. 9. The control section 29 has a counter for counting time but this counter is not shown in FIG. 9 but the counter 38 of FIG. 5 is used commonly for this purpose.

Referring to FIG. 9, in the control section 29, octave rate data ORD' provided from the gate 36 of FIG. 5 at a timing of the note clock pulse NCK is applied to an adder 56 through a line 55 as tone pitch data for key scaling. A multiplier 57 of the control section 29 provides rate data RD for counting time and this rate data RD is applied to a B input of the selector 37 of FIG. 5. This rate data is selected by the selector 37 when the timing signal T1 is "0" and is supplied to the counter 38. The counter 38, therefore, counts the rate data RTD at the time slot during which the timing signal T1 is "0", thus functioning as a counter for counting the delay time of delay key-on or crossfade time.

The delay rate data DRATE and crossfade rate data XRATE corresponding to a selected tone color are applied to a selector 58. The delay rate data DRATE is initially selected in response to a delay state signal DST and, upon ending of the delay time of "delay key-on", the crossfade rate data XRATE is selected in response to a crossfade state signal XST. Basically, the output of the selector 58 is supplied as the rate data ΔRD to the counter 38 (FIG. 5) through multipliers 59 and 57. However, to the multipliers 59 and 57 are supplied coefficient data for key scaling the delay time and the crossfade time and data obtained by scaling the output data of the selector 58 (either DRATE or XRATE) with this coefficient data constitutes the rate data ΔRD.

Delay rate key scaling data DKSD and crossfade rate key scaling data DKSD corresponding to a selected tone color are supplied to decoders 60 and 61 and decoded respectively therein. Outputs of the decoders 60 and 61 are applied to a selector 62 and the output of the decoder 60, i.e., data designating key scaling characteristic curve for "delay key-on" is selected in response to the delay state signal DST whereas the output of the decoder 61, i.e., data designating key scaling characteristic curve for "crossfade" is selected in response to the crossfade state signal XST. Among the four decoded outputs from the selector 62, a signal designating key scaling characteristics of "0%" and a signal indicating key scaling charateristics of "100%" are applied to A selection control inputs SA of selectors 64 and 65 through an OR gate 63, a signal designating key scaling characteristics of "50%" is applied to B selection control inputs SB of the selectors 64 and 65 and a signal designating key scaling characteristics of "25%" is applied to C selection control inputs SC of the selectors 64 and 65 respectively.

The selector 64 selects a numerical value "1" when the key scaling characteristics of "0%" or "100%" is designated, selects a numerical value "½" when the key scaling characteristics of "50%" and selects the numerical value "¼" when the key scaling characteristics of "25%" is designated. The selector 65 selects the numerical value "0" when the key scaling characteristics of "0%" or "100%" is designated, selects the numerical value "1" when the key scaling characteristics of "50%" is designated and selects the numerical value "3" when the key scaling characteristics of "25%" is designated. The output of the selector 64 is applied to the multiplier 59. The output of the selector 65 is applied to the adder 56 in which it is added with the octave rate data ORD' from the line 55. The output of the adder 56 is applied to an A input of a selector 66. To a B input of the selector 66 is applied numerical value "1". The selector 66 is selectively controlled by the signal designating the key scaling characteristics of "0%" provided by the selector 62 so as to select always "1" of the B input when the signal is "0%", i.e., when no key scaling is made, and otherwise, i.e., when the key scaling is made, select the output of the adder 56 at the A input. The output of the selector 66 is applied to the multiplier 57.

Owing to the above described construction, the rate data ΔRD is each key scaling characteristics is determined in accordance with the following formulas. The basic rate data RATE is either DRATE or XRATE. In the case of "0%"

$$\Delta RD = 1 \times 1 \times \text{RATE} = \text{RATE}$$

In the case of "25%"

$$\Delta RD = (ORD' + 3) \times \tfrac{1}{4} \times \text{RATE}$$

In the case of "50%"

$$\Delta RD = (ORD' + 1) \times \tfrac{1}{2} \times \text{RATE}$$

In the case of "100%"

$$\Delta RD = ORD' \times 1 \times \text{RATE} = ORD' + \text{RATE}$$

In the above formulas, the octave rate data ORD' has a numerical value corresponding to the octave at a timing of generation of the note clock pulse NCK and otherwise is "0".

In the above formulas, weight of the octave rate data ORD' is assumed to be "1" at the reference octave. In other words, even if the value of the octave rate data ORD used in the actual phase address counting is "1" at the first octave, "2" at the second octave, "4" at the third octave and "8" at the fourth octave, the octave rate data ORD' used in the key scaling is treated with the weight of, for example, "½" at the first octave, "1" at the second octave. "2" at the third octave and "4" at the fourth octave, assuming, for example, that the reference octave is the second octave.

By way of example, the note clock pulse NCK is constantly generated at each sampling timing at the reference tone pitch. If, for example, the note name of the reference tone pitch is B, the note clock pulse NCK of the note name B becomes "1" at each sampling period. In this case, the note clock pulses NCK for the note names A#, A, G#, G . . . D, C# and C which are lower than the reference tone pitch become thinned out pulses.

In the case of the reference tone pitch, e.g., the note name B of the second octave, the solution of the above formula is ORD'=1 and, accordingly, ΔRD=RATE in all cases of "0% ", "25%", "50%" and "100%" and the time DL as set by the basic rate data DRATE or XRATE is applied (see FIG. 4). In the case of a note name other than the note name of the reference tone pitch, the addition of the octave rate data ORD' is not made during a sampling period at which the note clock pulse NCK is absent due to thinning of the note clock pulse NCK so that multiplication coefficient for the rate data RATE during this sampling period becomes $\frac{3}{4}$ at "25%", $\frac{1}{2}$ at "50%" and 0 at "100%". Thus, multiplication coefficient of the rate data ΔRD differs between the sampling period during which the octave rate data ORD' is given and the sampling period during which the octave rate data ORD' is not given and its probability differs from note name to note name. Accordingly, the change rate of the count value in the case of cumulative counting of the rate data RD differs from note name to note name with a result that the key scaling control as shown in FIG. 4 is realized.

The rate data ΔRD which has been subjected to the key scaling control is applied to the B input of the selector 37 of FIG. 5, supplied to the counter 38 at a timing at which the timing signal T1 is "0" and cumulatively counted by the counter 38. The output of the counter 38 is supplied to the B input of the selector 52 of FIG. 7 as time count data CNT and is selectively delivered out at a timing at which the timing signal T1 is "0" and applied to the comparator 51. To the other input of the comparator 51 is applied maximum data in which all bits are "1" through the B input of the selector 50 at a timing at which the timing signal T1 is "0". Therefore, upon reaching of the time count data CNT of the counter 38 to the maximum value, the coincidence signal EQ of the comparator 51 becomes "1". As will be apparent, the larger is the value of the rate data RD applied to the counter 38, the higher is the speed of increase of the count data CNT and the shorter is the time length for reaching the maximum value.

The state controls of "delay key-on" and "crossfade" are performed by the counter 67 of FIG. 7. The counter 67 is reset by the key-on pulse KONP. A decoder 68 decodes the output of the counter 67 and produces a delay state signal DST when the count is "0", a crossfade signal XST when the count is "1" and a hold state HST when the count is "2". When the hold state signal HST is "0", an AND gate 69 is enabled and the output of an AND gate 70 is supplied to a count input of the counter 67. To the AND gate 70 are applied the coincidence signal EQ provided by the comparator 51 and an inverted signal of the timing signal T1.

Figure 10:
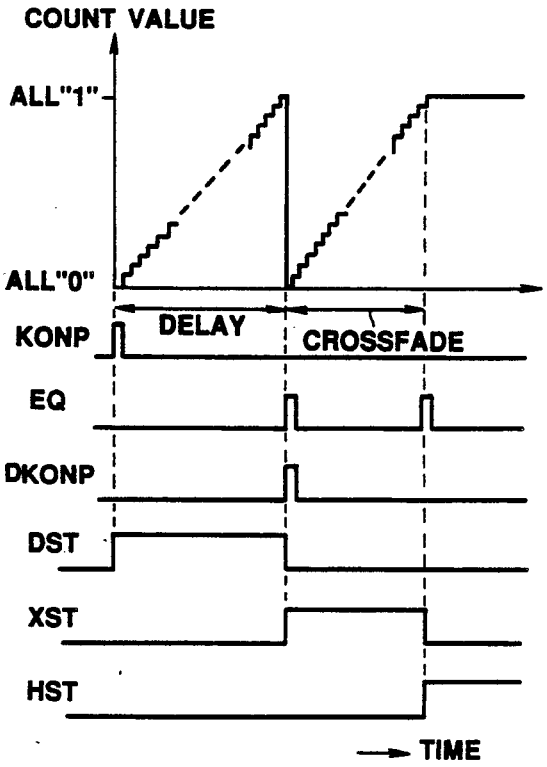
FIG. 10 is a time chart showing an example of operation of the delay key-on and crossfade control section.

Upon depression of a key, therefore, the delay state signal DST initially is turned to "1", designating the "delay key-on" control (see FIG. 10). The delay rate data DRATE and delay rate key scaling data DKSD are thereby selected in the selectors 58 and 62 of FIG. 9 and the rate data ΔRD for the "delay key-on" control is obtained in accordance with the above described key scaling operation.

Upon reaching of the count CNT of the counter 38 to the maximum value by the repeated addition of the rate data ΔRD for the delay key-on, the coincidence signal FQ is produced in the above described manner. To the AND gate 71 of FIG. 7 are applied this coincidence signal EQ, the delay state signal DST and the inverted signal of the timing signal T1. Upon reaching of the maximum value of the count CNT in the delay state, the AND gate 71 is enabled and the delay key-on pulse DKONP is generated (See FIG. 10). Simultaneously, the output of the AND gate 70 is turned to "1" and the contents of the counter 67 are counted up. Simultaneously, the output of the AND gate 72 of FIG. 5 is turned to "1" and this output is applied to the NOR gate 54 through an OR gate 73 whereby the output of the NOR gate 54 is turned to "0", the gate 41 of the counter 38 is disabled and the count value CNT of the counter 38 is cleared. By reaching of the count of the counter 67 to "1", the delay state signal DST is turned to "0" and the crossfade state signal XST is turned to "1" (see FIG. 10).

In this manner, the "delay key-on" control is finished and the "crossfade" control is started. Time during which the delay start signal DST is "1", i.e., time from start of generation of the normal key-on pulse KONP till generation of the delay key-on pulse DKONP is the delay time in the "delay key-on" control. As described, this delay time is basically established by the delay rate data DRATE and key scaled by the delay rate key scaling data DKSD and the tone pitch of the generated tone.

In the "crossfade" control state, the crossfade rate data XRATE and the crossfade rate key scaling data XKSD are selected in the selectors 58 and 62 in FIG. 9 and the rate data ΔRD for the "crossfade" control is obtained in accordance with the above described key scaling control.

Upon reaching of the count value CNT to the maximum value by the repeated addition of the rate data ΔRD for crossfading, the coincidence signal EQ is generated as described above. The contents of the counter 67 in FIG. 7 are thereby counted up, the crossfade state signal XST is turned to "0" and the hold state signal HST is turned to "1" (see FIG. 10).

In this manner, the "crossfade" control is finished. Time during which the crossfade state signal XST is "1" is the crossfade time. As described above, this crossfade time is basically established by the crossfade rate data XRATE and is key scaled by the crossfade key scaling data XKSD and the tone pitch of the generated tone.

Generation of Key-on Pulses in Accordance with the Tone Generation Mode

In FIG. 7, the state control section 30 has a function of producing a PCM key-on pulse PKONP designating start of tone generation in the PCM system tone signal generation circuit 20 and an FM key-on pulse FKONP designating start of tone generation in the FM system tone signal generation circuit 21 in accordance with the tone generation mode.

The ordinary key-on pulse KONP which is generated in response to start of depression of a key is applied to the gate 47. The output of the gate 47 is provided as the PCM key-on pulse PKONP through the OR gate 48 and also is supplied to a set input S of the above described flip-flop 46. To the control input of the gate 47 is applied, through an OR gate 74, the simple mixing mode signal MIX, the FM delay key-on mode signal FMD, or the FM delay key-on and crossfade mode signal FMDX. When either of these modes is selected as the tone generation mode, the PCM system tone signal generation circuit 20 starts generation of a tone in response to actual start of depression of a key (see FIGS. *2a*, *2b* and *2d*) so that the gate 47 is opened when either of the signals MIX, FMD or FMDX indicating that either of these modes is selected is "1"and the key-on pulse KONP is provided directly as the PCM key-on pulse PKONP.

The key-on pulse KONP is applied to the gate 75 and the output of the gate 75 is provided as the FM key-on pulse FKONP through the OR gate 76. To the control input of the gate 75 is applied, through an OR gate 77, the simple mixing mode signal MIX, the PCM delay key-on mode signal PCMD, or the PCM delay key-on and crossfade mode signal PCMDX. When either of these modes is selected as the tone generation mode, the FM system tone signal generation circuit 21 starts tone generation in response to actual start of depression of a key (see FIGS. *2c* and *2e*) so that the gate 75 is opened when either of the signals MIX, PCMD and PCMDX indicating that either of these modes is selected is "1" and the key-on pulse KONP is provided directly as the FM key-on pulse FKONP.

The delay key-on pulse DKONP produced by the AND gate 71 when the delay time in the "delay key-on" has elapsed is applied to gates 78 and 79. To a control input of the gate 78 is applied, through an OR gate 80, the PCM delay key-on mode signal PCMD or the PCM delay key-on and crossfade mode signal PCMDS. The output of the gate 78 is latched by a latch circuit 81 in synchronism with the timing signal T1 and is provided as the PCM key-on pulse PKONP through the OR gate 48. In the case of the PCM delay key-on mode or PCM delay key-on and crossfade mode, tone generation in the PCM system tone signal generation circuit 20 is started after lapse of the delay time (see FIGS. *2c* and *2e*) and, accordingly, when either of these modes is selected, the delay key-on pulse DKONP (see FIG. 10) is provided as the PCM key-on pulse PKONP.

To a control input of the gate 79 is applied, through an OR gate 82, the FM delay key-on signal FMD or the FM delay key-on and crossfade mode signal FMDX. The output of the gate 79 is latched by a latch circuit 83 in synchronism with the timing signal T1 and is provided as the FM key-on pulse FKONP through the OR gate 76. In the case of the FM delay key-on mode or the FM delay key-on and crossfade mode, tone generation in the FM system tone signal generation circuit 21 is started after lapse of the delay time (see FIGS. *2a*, *2b* and *2d*) and, accordingly, when either of these modes is selected, the delay key-on pulse DKONP (see FIG. 10) is provided as the FM key-on pulse FKONP. The latch circuits 81 and 83 are provided for synchronizing timings of the key-on pulses PKONP and FKONP with a channel timing for generating a tone signal.

The PCM key-on pulse PKONP is applied to the NOR gate 54 (FIG. 5) for clearing contents of the counter 38 in the PCM system tone signal generation circuit 20 and thereby disables the gate 41 of the counter 38. The FM key-on pulse FKONP is applied to the FM system tone signal generation circuit 21 to clear similarly contents of the phase address counter. The key-on pulses PKONP and FKONP are applied to the envelope generator 23 for designating generation of the envelope signal.

The FM System Tone Signal Generation Circuit 21

Figure 11:
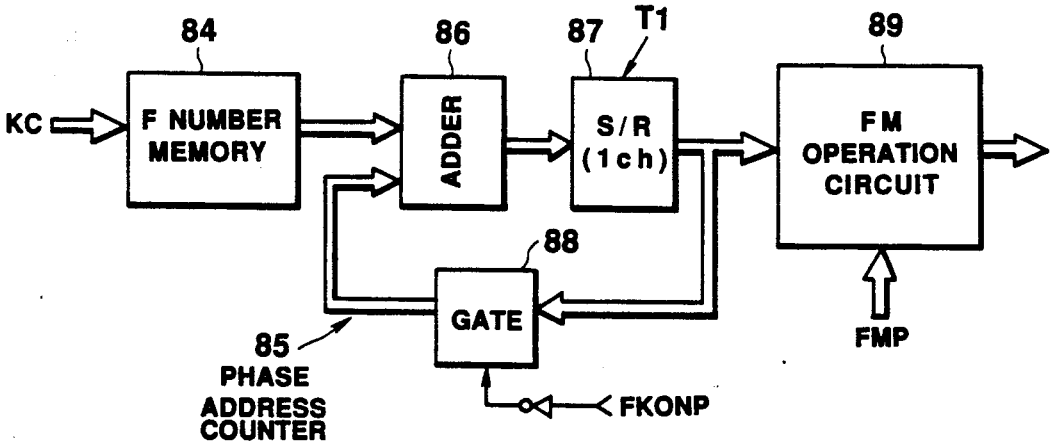
FIG. 11 is a block diagram showing an example of the second tone signal generation circuit (FM system) in FIG. 1.

FIG. 11 shows schematically an example of the FM system tone signal generation circuit 21. For brevity of explanation, the number of tone generation channel is one in this example.

An F number memory 84 prestores, for each tone pitch, "F number" which is a numerical value which is proportional to the frequency of each tone pitch. An F number of a tone to be generated is read out in response to the key code KC supplied from the buffer register 18 (FIG. 1). The read out F number is supplied to an adder 86 of a phase address counter 85. The phase address counter 85 includes an adder 86, a one-stage shift register 87 which is shift-controlled by the timing signal T1 and a gate 88. The output of the adder 86 is supplied to the shift register 87 and the output of the shift register 87 is applied to the other input of the adder 86 through the gate 88. The gate 88 is controlled by a signal obtained by inverting the FM key-on pulse FKONP for once clearing contents of the phase address counter 85 at start of tone generation. Thereafter, the F number is repeatedly added in the phase address counter 85 at each sampling period and a phase address signal is produced by the counter 85.

An FM operation circuit 89 is a circuit for executing a frequency modulation operation for synthesizing a tone. The circuit 89 receives the phase address signal from the counter 85 and the algorithm and parameter data FMP and executes the frequency modulation operation in accordance with these data. A tone signal synthesized in the FM operation circuit 89 is supplied to the multiplier 25 (FIG. 1) in which it is multiplied by the envelope signal FEG.

Tone Control Corresponding to the Tone Generation Mode

Figure 12:
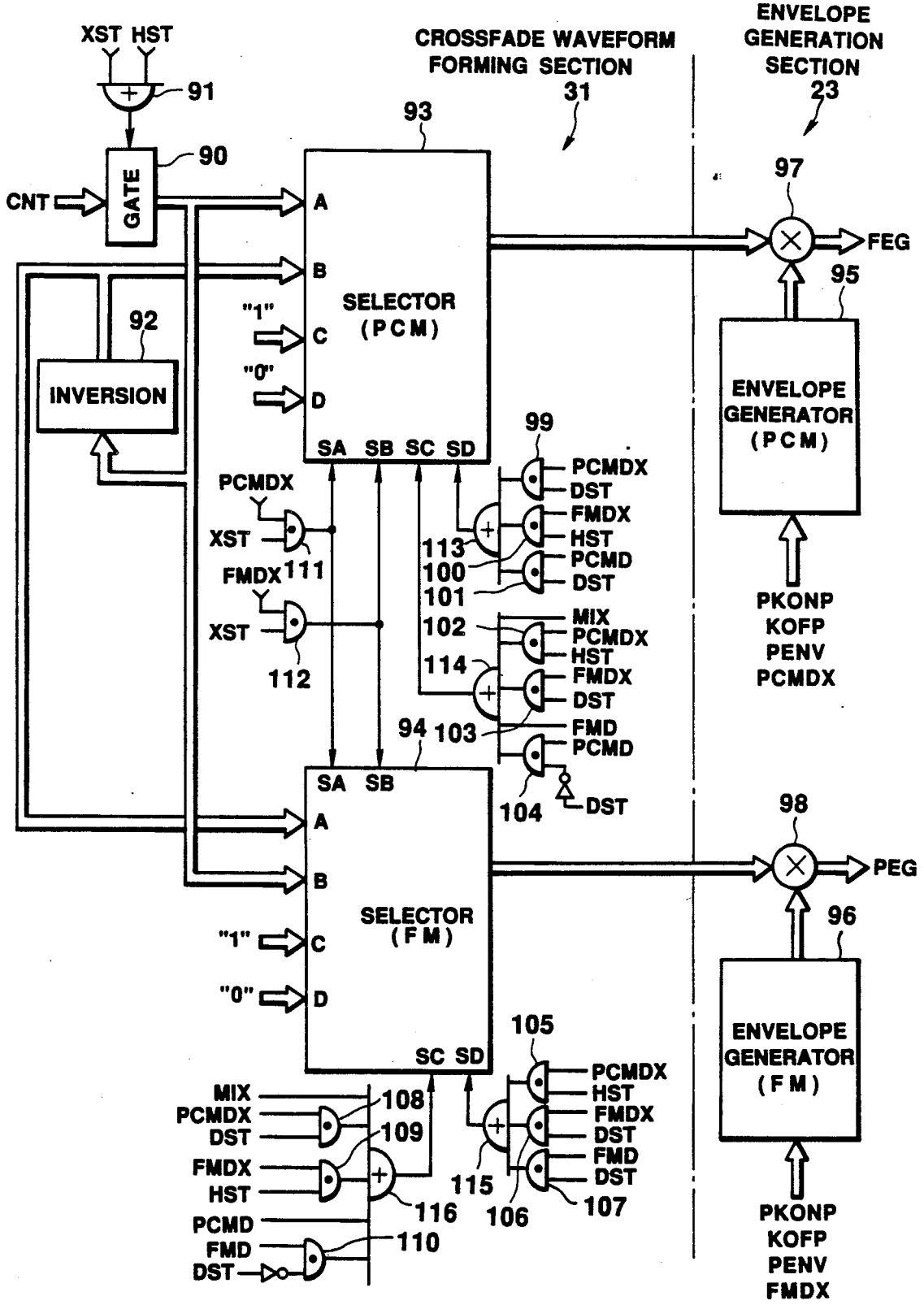
FIG. 12 is a block diagram showing an example of the crossfade waveform forming section and envelope generation section.

A specific example of the crossfade waveform forming section 31 and an example of the envelope generation section 23 are shown in FIG. 12. The crossfade waveform forming section produces, in accordance with a selected tone generation mode, crossfade waveform data for controlling a tone amplitude in the PCM system tone signal generation circuit 20 and crossfade waveform data for controlling a tone amplitude in the FM system tone signal generation circuit 21. The crossfade waveform data for PCM is provided from a selector 93 for PCM and applied to a multiplier 97 of the envelope generator 23 in which it is multiplied with an envelope signal for PCM generated by an envelope generator 95 for PCM. The crossfade waveform data for FM is provided from a selector 94 for FM and applied to a multiplier 98 of the envelope generator 23 in which it is multiplied with an envelope signal for FM generated by an envelope generator 96 for FM. The outputs of the multipliers 97 and 98 are provided as the envelope signals PEG and FEG which have been weighted by the crossfade waveforms and supplied to the mutlipliers 24 and 25 of FIG. 1.

To the envelope generator 95 for PCM are applied the PCM key-on pulse PKONP, envelope parameter PENV for PCM, key-off pulse KOFP and PCM delay key-on and crossfade mode signal PCMDX and the envelope generator 95 generates an envelope shape signal in response to these data. To the envelope generator 96 for FM are applied the FM key-on pulse FKONP, envelope parameter FENV for FM, key-off pulse KOFP and FM delay key-on and crossfade mode signal FMDX and the envelope generator 96 generates an envelope shape signal in response to these data.

In the example of FIG. 12, the crossfade waveform forming section 31 utilizes the time count data CNT for crossfading in the counter 38 of FIG. 5 as the crossfade waveform data. As characteristic for gradually rising a tone in the crossfade control, the increasing curve of the count data CNT is used as it is whereas characteristic for gradually attenuating a tone is formed by converting a binary value of the count data CNT to a decreasing curve by inverting the binary value.

The count data CNT provided by the counter 38 of FIG. 5 is supplied to a gate 90. The gate 90 is opened by the crossfade state signal XST or hold state signal HST supplied from an OR gate 91. The count data CNT for "data key-on" thereby is blocked by the gate 90 and the count data CNT for "crossfade" is gated out of the gate 90. The count data CNT gated out of the gate 90 is supplied to an A input of a selector 93 for PCM and also to a B input of a selector 94 for FM. The count data CNT gated out of the gate 90 is inverted in all bits thereof by an inversion circuit 92 and the output of the inversion circuit 92 is supplied to a B input of the selector 93 for PCM and also to an A input of the selector 94 for FM. To C inputs of the selectors 93 and 94 are applied the maximum value, i.e., data in which all bits are "1" whereas to D inputs of the selectors 93 and 94 are applied the minimum value, i.e., data in which all bits are "0".

To control inputs of the selectors 93 and 94 are applied, through AND gates 99 to 112 and OR gates 113 to 116, the signals MIX, PCMD, PCMDX, FMD and FMDX respectively designating the tone generation mode and the state signals DST, XST, and HST.

Crossfade waveform generation modes and tone generation control modes in accordance with the respective tone generation modes are described below.

Figure 2A:
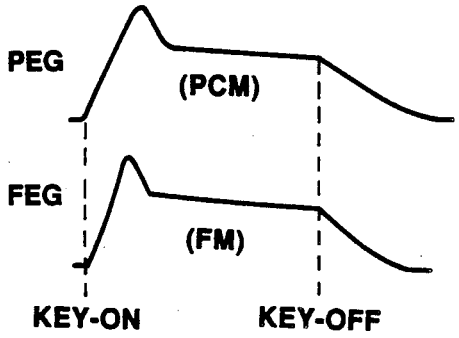
FIGS. 2*a* to 2*e* are diagrams for explaining typical examples of tone generation mode which can be selected in the embodiment.

1) Simple mixing mode (FIG. 2*a*)

When the simple mixing mode has been selected, the signal MIX is turned to "1" and the selectors 93 and 94 select the C input. The outputs of the selectors 93 and 94 thereby become "1" constantly so that the outputs of the envelope generators 95 and 96 are provided directly as the envelope signals PEG and FEG. Accordingly, as shown in FIGS. 2*a*, the tone generation control is made so that tones are generated simultaneously in the PCM system tone signal generation circuit 20 and the FM system tone signal generation circuit 21.

Figure 2B:
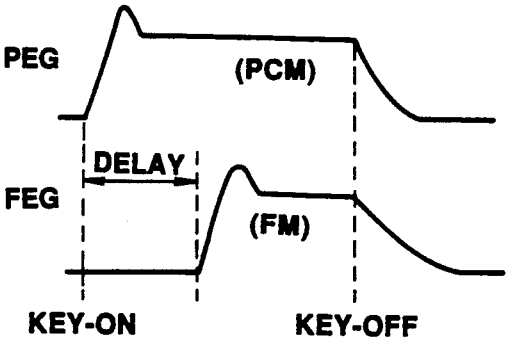

2) FM Delay Key-on Mode (FIG. 2*b*)

When the FM delay key-on mode has been selected, the signal FMD is turned to "1" and the selector 93 constantly selects the C input. The selector 94 selects the D input when the delay state signal DST is "1" and selects the C input when the delay state signal DST is "0". The output of the selector 93 thereby maintains "1" constantly and the output of the envelope generator 95 is provided directly as the envelope signal PEG. At this time, the PCM key-on pulse PKONP is generated in correspondence to the ordinary key-on pulse KONP and the envelope signal PEG rises simultaneously with depression of the key. On the other hand, the selector 94 selects all "0" during the delay time and selects all "1" after lapse of the delay time. The FM key-on pulse FKONP is generated in correspondence to the delay key-on pulse DKONP and the envelope signal FEG rises after lapse of the delay time. Accordingly, as shown in FIG. 2*b*, tone generation is started first in the PCM system tone signal generation circuit 20 and is started with a delay in the FM system tone signal generation circuit 21 and thereafter tone generation is made concurrently in the two circuits.

Figure 2C:
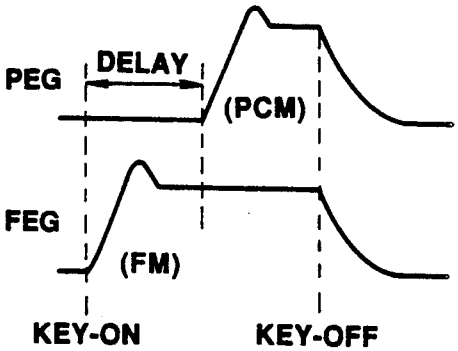

3) PCM delay key-on mode (FIG. 2*c*)

When the PCM delay key-on mode has been selected, the signal PCDM is turned to "1" and the selector 94 constantly selects the C input. The selector 93 selects the D input when the delay state signal DST is "1" and selects the C input when the delay state signal DST is "0". The output of the selector 94 thereby maintains "1" constantly and the output of the envelope generator 96 is provided directly as the envelope signal FEG. At this time, the FM key-on pulse FKONP is generated in correspondence to the ordinary key-on pulse KONP and the envelope signal FEG rises with depression of the key. On the other hand, the selector 93 selects all "0" during the delay time and selects all "1" after lapse of the delay time. The PCM key-on pulse PKONP is generated in correspondence to the delay key-on pulse DKONP and the envelope signal PEG rises at the end of the delay time. Accordingly, as shown in FIG. 2*c*, tone generation is started first in the FM system tone signal generation circuit 21 and is started with delay in the PCM system tone signal generation circuit 20 and thereafter tone generation is made concurrently in the two circuits.

Figure 2D:
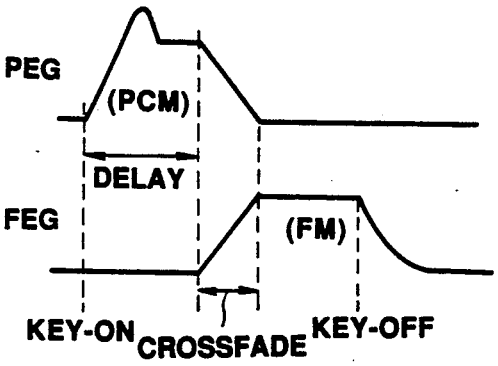

4) FM delay key-on and crossface mode (FIG. 2*d*)

When the FM delay key-on and crossfade mode has been selected, the signal FMDX is turned to "1" and the selector 93 selects the C input when the delay state signal DST is "1", selects the B input when the crossfade state signal XST is "1" and selects the D input when the hold state signal HST is "1". The crossfade waveform data for PCM provided by the selector 93 thereby maintains all "1" during the delay time, attenuates gradually from all "1" toward all "0" during the crossfade time and maintains all "0" after the end of crossfade. The PCM key-on pulse PKONP is generated in correspondence to the ordinary key-on pulse KONP and the envelope signal PEG rises with depression of the key.

The selector 94 selects the D input when the delay state signal DST is "1", selects the B input when the crossfade state signal XST is "1" and selects the C input when the hold state signal HST is "1". The crossfade waveform data for FM provided by the selector 94 thereby maintains all "0" during the delay time, rises gradually from all "0" toward all "1" during the crossfade and maintains all "1" after the end of crossfade. The FM key-on pulse FKONP is generated in correspondence to the delay key-on pulse DKONP. The envelope generator 96 for FM is assumed to generate an envelope shape signal which rises instantly to the maximum level in response to the key-on pulse FKONP when the FM delay key-on and crossfade mode signal FMDX is "1". The envelope signal FEG provided by the multiplier 98 thereby rises after lapse of the delay time with a curve corresponding to the crossfade rising waveform from the selector 94.

Accordingly, as shown in FIG. 2*d*, tone generation is started first in the PCM system tone signal generation circuit 20 and is started with delay in the FM system tone signal generation circuit 21 and the succeeding tone signal from the FM system tone signal generation circuit 21 is caused to rise gradually whereas the tone signal from the preceding PCM system tone signal generation circuit 20 is caused to attenuate gradually.

Figure 2E:
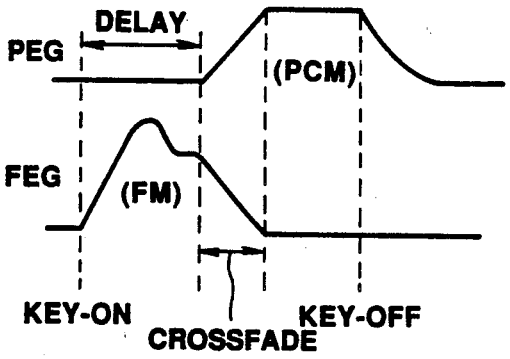

5) PCM delay key-on and crossfade mode (FIG. 2*e*)

When the PCM delay key-on and crossface mode has been selected, the signal PCMDX is turned to "1" and the selector 94 selects the C input when the delay state signal DST is "1", selects the A input when the crossfade state signal XST is "1" and selects the D input when the hold state signal HST is "1". The crossfade waveform data for FM provided by the selector 94 thereby maintains all "1" during the delay time, attenuate gradually from all "1" toward all "0" during the crossfade time and maintains all "0" after lapse of the crossfade time. The FM key-on pulse FKONP is generated in correspondence to the ordinary key-on pulse KONP and the envelope signal FEG rises with depression of the key.

The selector 93 selects the D input when the delay state signal DST is "1", selects the A input when the crossfade state signal XST is "1" and selects the C input when the hold state signal HST is "1". The crossfade waveform data for PCM provided by the selector 93 thereby maintains all "0" during the delay time, rises gradually from all "0" toward all "1" during the crossfade time and maintains all "1" after lapse of the crossfade time. The PCM key-on pulse PKONP is generated in correspondence to the delay key-on pulse DKONP. The envelope generator 95 for PCM is assumed to generate an envelope shape signal which rises instantly to the maximum level in response to the key-on pulse PKONP when the PCM delay key-on and crossfade mode signal PCMDX is "1". The envelope signal PEG provided by the multiplier 97 thereby rises with a curve corresponding to the crossfade rising waveform from the selector 93 after lapse of the delay time.

Accordingly, as shown in FIG. 2*e*, tone generation is started first in the FM system tone signal generation circuit 21 and is started with delay in the PCM system tone signal generation circuit 20 and this succeeding tone signal of the PCM system tone signal generation circuit 20 is caused to rise gradually whereas the preceding tone signal of the FM system tone signal generation circuit 21 is caused to attenuate gradually.

Modifications

In the above described embodiment, the key scaling characteristics of the delay rate or crossfade rate is established in accordance with a selected tone color. The invention however is not limited to this but the key scaling characteristics may be selected as desired by suitable key scaling characteristics selection means.

In the above described embodiment, the basic value of the delay rate or crossfade rate is established in accordance with a selected tone color. The invention however is not limited to this but the basic value may be selected as desired by suitable rate selection means.

In the above described embodiment, the tone generation mode is automatically established in accordance with a selected tone color. Alternatively, the tone generation mode may be selected as desired by suitable selection means.

The count of the delay time or crossfade time need not be a count of incremental value data but it may be a count of clock pulse of variable frequency or a count which is a combination of a clock pulse of variable frequency and incremental value data. It may also be a count of frequency of a tone waveform.

In the above described embodiment, key scaling of the delay rate or crossfade rate is made for each individual tone pitch. Alternatively, this key scaling may be performed with respect to a suitable tone range. In this Specification, performing of key scaling in accordance with tone pitch includes performing of key scaling for each predetermined tone range.

The key scaling control of the delay time or crossfade time is not limited to a variable control of the count rate but may be a variable control of a target value of the count in accordance with the tone pitch.

In the above described embodiment, the rising crossfade waveform and falling crossface waveform are of the same time length but the time length may be different between two of them. Further, the rising crossfade waveform and falling crossfade waveform need not be linear but they may be of an exponential or logarithmic characteristic or other characteristic.

The tone source system or tone signal generation system in the first and second tone signal generation circuits 20 and 21 need not be the above described system but may be of other system. For example, the waveform stored in the waveform memory of the first tone signal generation circuit 20 is not limited to a rise portion and a part of sustain portion of a tone but may be a full waveform from rising of the tone to the end of generation of the tone. The method of coding of data stored in the waveform memory is not limited to PCM (pulse-code modulation) but it may be other suitable one selected from coding systems such as DPCM (difference PCM), ADPCM (adaptive difference PCM). DM (delta modulation) and ADM (adaptive delta modulation). Algorithm of the frequency modulation operation in the second tone signal generation circuit 21 may be any suitable one. The tone synthesis modulation operation in the second tone signal generation circuit 21 is not limited to the frequency modulation operation but other suitable modulation operation such as an amplitude modulation operation or an amplitude modulation operation using a time window may be employed. Further, a tone synthesis system other than the modulation operation type tone synthesis system may be employed.

The tone pitch of a generated tone in each tone signal generation circuit need not be the same but may differ between the respective circuits. For example, transposition or pitch adjustment may be made independently in each tone signal generation circuit or tones differing from each other by a suitable scale may be generated.

The number of the tone signal generation circuits is not limited to two but there may be more tone signal generation circuits.

The number of tone generation channel is not limited to one but plural tone generation channels may be provided.

Description of the Entire Construction of Another Embodiment

Focusing on the structure of two different tone signal generation circuits, description will be made about another embodiment of the invention.

Figure 13:
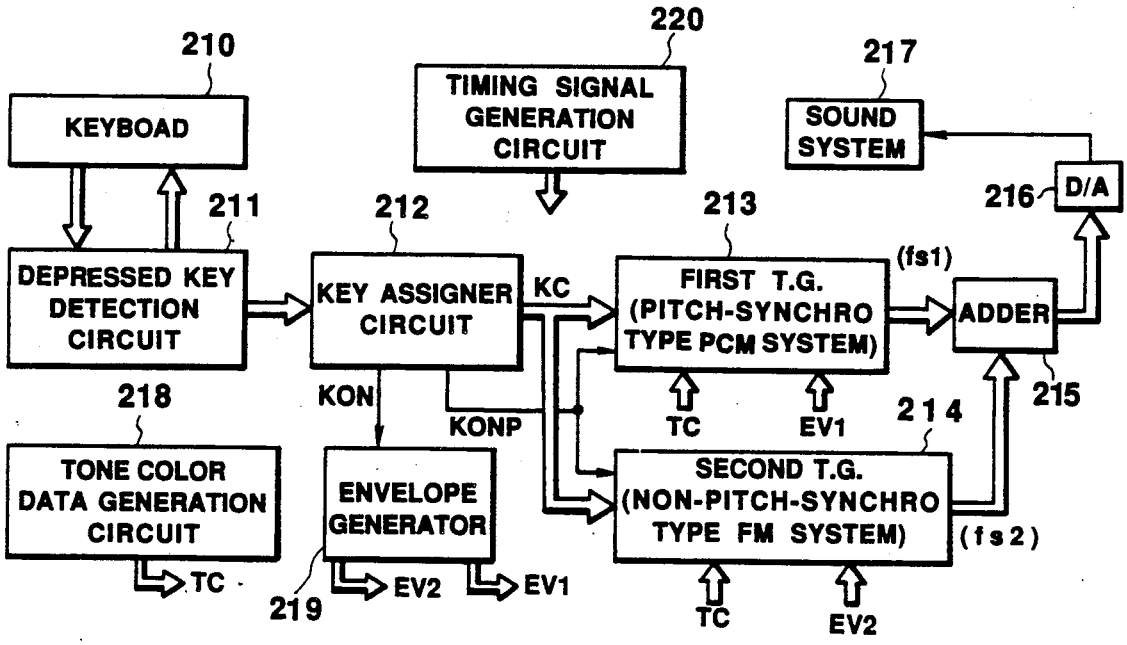
FIG. 13 is a block diagram showing schematically another embodiment of the electronic musical instrument of the invention.

Referring to FIG. 13, a keyboard 210 has keys for designating tone pitches of tones to be generated. A depressed key detection circuit 211 detects depression and release of a key in the keyboard 210 and supplies a signal corresponding to the depressed or released key to a key assigner circuit 212. The key assigner circuit 212 assigns generation of the tone corresponding to the depressed key to one of plural tone generation channels and generates a key code KC representing a key which has been assigned to a certain channel at a time division timing corresponding to the channel, a key-on signal KON representing whether or not the depression of the key is still continuing and a key-on pulse KONP corresponding to rise of the key-on signal KON. By way of example, the number of the tone generation channels is set at eight.

The key code KC generated by the key assigner circuit 212 is supplied to a first tone signal generation circuit 213 and a second tone signal generation circuit 214.

The first tone signal generation circuit 213 is a pitch-synchronizing type tone signal generation circuit which generates a tone signal having a pitch which is determined by a given key code KC and outputs this tone signal with a first sampling frequency fs1 synchronized with this pitch. The number of the tone generation channels in this first tone signal generation circuit 213 is eight as described above and a digital tone signal is generated in the respective channels in response to the key code KC assigned to the respective channels. By way of example, the tone signal generation system in this first tone signal generation circuit 213 includes memory means prestoring waveform data of plural tone waveforms corresponding to various tone colors and waveform data of a tone waveform corresponding to a selected tone color is read out from this memory means and a tone signal is generated on the basis of this read out waveform data. This system will be abbreviated as "PCM system" in the same manner as was described with respect to the first embodiment.

A second tone signal generation circuit 214 is a non-pitch-synchronizing type tone signal generation circuit which generates a tone signal having a pitch which is determined by a given key code KC and outputs this tone signal with a second sampling frequency fs2 which is not synchronized with the pitch. The number of the tone generation channels in this second tone signal generation circuit 214 is also eight and a digital tone signal is generated in respective channels in response to the key code KC assigned to the respective channels. By way of example, the tone signal generation system in this second tone signal generation circuit 214 generates a tone signal by executing a tone synthesis operation of a frequency modulation type and this system will be abbreviated as "FM system" in the same manner as described above.

The output tone signals of the first tone signal generation circuit 213 and the second tone signal generation circuit 214 are added together in a digital manner by an adder 215 and an output of the adder 215 is supplied to a sound system 217 after being converted to an analog signal by a digital-to-analog converter 216.

A tone color data generation circuit 218 produces tone color data TC corresponding to a selected tone color. This tone color data TC is supplied respectively to the first tone signal generation circuit 213 and the second tone signal generation circuit 214 for designating the tone colors to be generated in the respective tone signal generation circuits 213 and 214. A nominally common tone color is designated in the respective tone signal generation circuits 213 and 214 by this tone color data TC. The tone color in these circuits however may be different subtly between the two circuits depending upon difference in the tone signal synthesis system. Besides, presence or absence and the manner of timewise change in the tone color may also be different between the two circuits. Thus, the tone quality of a tone to be generated may differ in a desired manner between the tone signal generation circuits 213 and 214.

An envelope generator 219 generates envelope signals EV1 and EV2 used by the tone signal generation circuits 213 and 214. The envelope signals EV1 and EV2 include envelope signals of various functions such as envelope signals for establishing tone volume levels of tone signals generated by the tone signal generation circuits 213 and 214 and envelope signals for establishing timewise variable controls of tone color or other tone elements. The envelope signals for establishing the tone volume levels of the tone signals generated by the tone signal generation circuits 213 and 214 function as coefficients for controlling the ratio of addition of the output tone signals of the tone signal generation circuits 213 and 214 in the adder 215 and function as timewise changing coefficients for timewise changing the ratio of addition.

A timing signal generation circuit 220 generates various timing signals for controlling time division processings and other operations.

The first and second tone signal generation circuits 213 and 214 generate, channel by channel, tone signals having a pitch corresponding to a common tone pitch for a key code KC for each channel supplied from the key assigner circuit 212. There may be provided, if necessary, a suitable pitch difference or shift in the tone pitch or tone scale between the first tone signal generation circuit 213 and the second tone signal generation circuit 214. For example, the tone signal generation circuits 213 and 214 may perform, independently from each other, controls such as tuning, transposition, vibrato, glide and pitch control.

If, for example, in adding the output tone signals of the tone signal generation circuits 213 and 214 together, the tone signals are combined and synthesized at a suitable ratio of addition over the entire tone generation period from start of generation of the tones to the end thereof, a duet effect may be obtained, i.e., two tones having a common tone pitch and a common tone color (though actual pitch and tone quality may be caused to differ subtly from each other) may be generated simultaneously. In other words, while the maximum number of tones to be generated is eight which corresponds to the number of channels in each of the tone signal generation circuits 213 and 214, the duet effect is obtained by simultaneous generation of tones in the two channels.

For another example, the output tone signals of the two tone signal generation circuits 213 and 214 may be caused to change to crossfade with each other depending upon tone generation stages such as a rise portion and a sustain portion of a tone and these tone signals may be combined and synthesized together. An optimum tone synthesis corresponding to each tone generation stage can be achieved by such arrangement.

In the first tone signal generation circuit 213, there is provided a note clock generation circuit 221 (FIG. 15) which generates a note clock pulse NCK having a frequency which corresponds to the tone pitch of a tone to be generated. If a tone signal is generated in synchronism with a timing of generation of this note clock pulse NCK, an effective sampling frequency of the tone signal is harmonized with its pitch and, besides, pitch synchronization is achieved if note clock pulses NCK of all tone pitches are set to harmonize with the basic sampling frequency fs1 of the system.

In this embodiment, in the first tone signal generation circuit 213, tone signals of the respective channels are generated on a time shared basis so that the note clock pulses NCK of tones assigned to the respective channels must be generated on a time shared basis. It is also desirable, for increasing accuracy of the pitch synchronization, that the frequency of the note clock pulse NCK be relatively high. Generation and pitch synchronizing processing of the note clock pulse NCK in the first tone signal generation circuit 213, therefore, must be made at a time division timing of a relatively high rate.

On the other hand, the key assigner circuit 212 and the second tone signal generation circuit 214 of the non-pitch-synchronizing type are not required to be operated at a time division timing of such a high rate but, as these circuits, circuits operated at a time division timing of a relatively low rate are rather preferable from the standpoint of circuit design and tone generation operation processings.

In the present embodiment, therefore, necessary circuits are operated at two kinds of time division operation rates, i.e., high rate and low rate. More specifically, time division processings in the respective channels are performed at a low rate time division timing in the key assigner circuit 212, the second tone signal generation circuit 214 of the non-pitch-synchronizing type and a circuit portion in the first tone signal generation circuit 213 where a high rate time division processing is unnecessary whereas time division processings in the respective channels are performed at a high rate time division timing in a circuit portion in the first tone signal generation circuit 213 where a high rate time division processing is necessary. Accordingly, outputs KC, KON and KONP of the key assigner circuit 212 are produced at the low rate time division timing. Since, however, there is a circuit portion in the first tone signal generation circuit 213 where the high rate time division processing is necessary, means for converting the time division rate of a signal from a low rate to a high rate or, conversely, from a high rate to a low rate is provided in the first tone signal generation circuit 213 for matching with the time division rate of such circuit portion.

Specific examples of respective circuits in FIG. 13 will now be described.

Description of Time Division Timing

An example of the low rate and high rate time division timings will first be described with reference to FIG. 14.

The high rate time division timing is formed by using one period of master clock pulse $\phi$ M being used as one time slot. On the assumption that the number of time division tone generation channels is eight, time slots of the first to eighth channels in the high rate time division timing, i.e., high rate channel timings, are shown in the column of Hch in FIG. 14. The sampling period of one tone in the high rate time division timing therefore is eight times as long as the master clock pulse $\phi$ M.

The low rate time division timing is formed by using one period of clock pulse $\phi$ L having a period of eight times as long as the master clock pulse $\phi$ M as one time slot. Time slots of the first to eighth channels in the low rate time division timing, i.e., the low rate channel timings, are shown in the column of Lch in FIG. 14. The sampling period of one tone in the low rate time division timing therefore is eight times as long as the clock pulse $\phi$ L(sixty-four times as long as the master clock pulse $\phi$ M).

Assuming that the frequency of the master clock pulse $\phi$ M is 3.2 MHz, the sampling frequency of one tone in the high rate time division timing Hch (corresponding to the first sampling frequency fs1) becomes 400 kHz and the sampling frequency of one tone in the low rate time division timing Lch (corresponding to the second sampling frequency fs2) becomes 50 kHz. In this manner, the first sampling frequency fs1 and the second sampling frequency fs2 are established so that the former becomes integer multiple of the latter.

Figure 14:
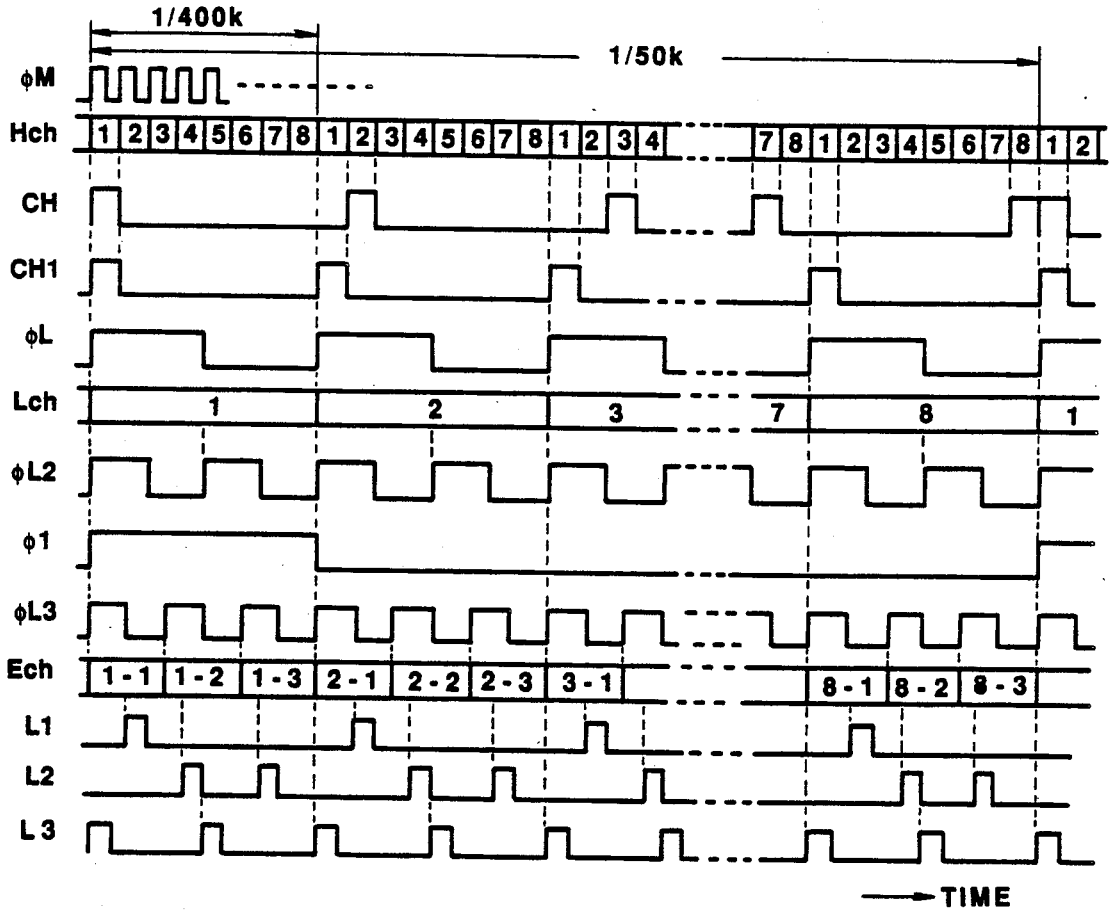
FIG. 14 is a time chart showing an example of the clock pulse and various operation timings in the embodiment of FIG. 13.

In FIG. 14, a channel synchronizing pulse CH is used when the time division rate of a signal is to be changed from a low rate to a high rate or from a high rate to a low rate. The pulse CH consists of eight shots of pulses each of which is generated at a high rate time division timing in each of the channels 1–8 during 64 $\phi$ M (64 periods of the master clock pulse $\phi$ M) during which the low rate channel timing completes one cycle. For example, one shot of pulse is generated at the high rate time division timing of the channel 1 and another shot of pulse is generated at the high rate time division timing of the channel 2 which is 9 $\phi$ M (9 periods of the master clock pulse $\phi$ M) later, and subsequently one shot of pulse is generated at each high rate time division timing of each of the channels 4, 5, 6, 7 and 8. After generation of one shot of pulse at the high rate time division timing of the channel 8, one shot of pulse is generated at the high rate time division timing of the channel 1 again which is 1 $\phi$ M (one period of the master clock pulse $\phi$ M) later.

Description of P Number

For performing the pitch synchronizing type tone signal forming in the first tone signal generation circuit 213, information referred to as "P number", for example, is employed. The "P number" is a number indicating a sample point number in one period of a tone waveform having a frequency corresponding to each tone pitch. Since plural tones of desired tone pitches can be generated on a time shared basis, the basic sampling frequency in the first tone signal generation circuit 213, i.e., the first sampling frequency fs1, is common through all tone pitches and this frequency has a period which is, as described above, eight times as long as the master clock pulse $\phi$ M (i.e., frequency of 400 kHz). On the other hand, since the basic sampling frequency is common, the P number of each tone pitch exhibits a value which differs depending upon the frequency of the tone pitch. If frequency of a certain tone pitch is denoted by fn and the common sampling frequency by fs1, the P number corresponding to the tone pitch is determined by the following equation (1):

$$P\ \text{number} = fs1 \div fn \qquad (1)$$

Description of Note Clock Pulse

In the note clock generation circuit 221 (FIG. 15), the note clock pulse NCK is obtained by frequency-dividing the common sampling frequency fs1 established on the basis of the master clock pulse $\phi$ M in accordance with the P number. As will be apparent from the foregoing description, the P number is the number of periods, i.e., the sample point number, of the common sampling frequency fs1 in waveform of one period. If an effective sample point number per one period of a tone waveform which can be generated in the first tone signal generation circuit 213 is denoted by N (e.g., N=64) and the frequency dividing number for frequency-dividing the common sampling frequency fs1 is represented by $$\text{frequency dividing number} = P\ \text{number} \div N \quad (2),$$

N shots of pulses can be obtained per one period of the tone as a frequency divided output, and all of N effective sample points can thereby be established. By frequency-dividing the common sampling frequency fs1 by the frequency dividing number determined in this manner, the following equation (3) is derived from the above equations (1) and (2);

$$fs1 \div \text{frequency-dividing number} = (fn \times P\ \text{number}) \div (P\ \text{number} \div N) = fn \times N = fe \quad (3)$$

By changing a sample point address with this frequency-divided output, the effective sampling frequency fe can be established. The effective sampling frequency fe established in this manner is harmonized with the tone pitch frequency fn and pitch synchronization thereby is realized. The note clock pulse NCK generated by the note clock generation circuit 221 is a frequency-division output signal represented by the equation (3), i.e., a signal having the effective sampling frequency fe.

The frequency dividing number determined by the equation (2) is not necessarily an integer but it often inclues a decimal. The frequency dividing operation in the note clock generation circuit 221 therefore is performed in such a manner that frequency-division is made with two integers which are proximate to the frequency dividing number determined by the equation (2) and the same result as if frequency division was made by the frequency dividing number determined by the equation (2) is obtained as an average result. (A specific example of the first tone signal generation circuit 213).

Figure 15:
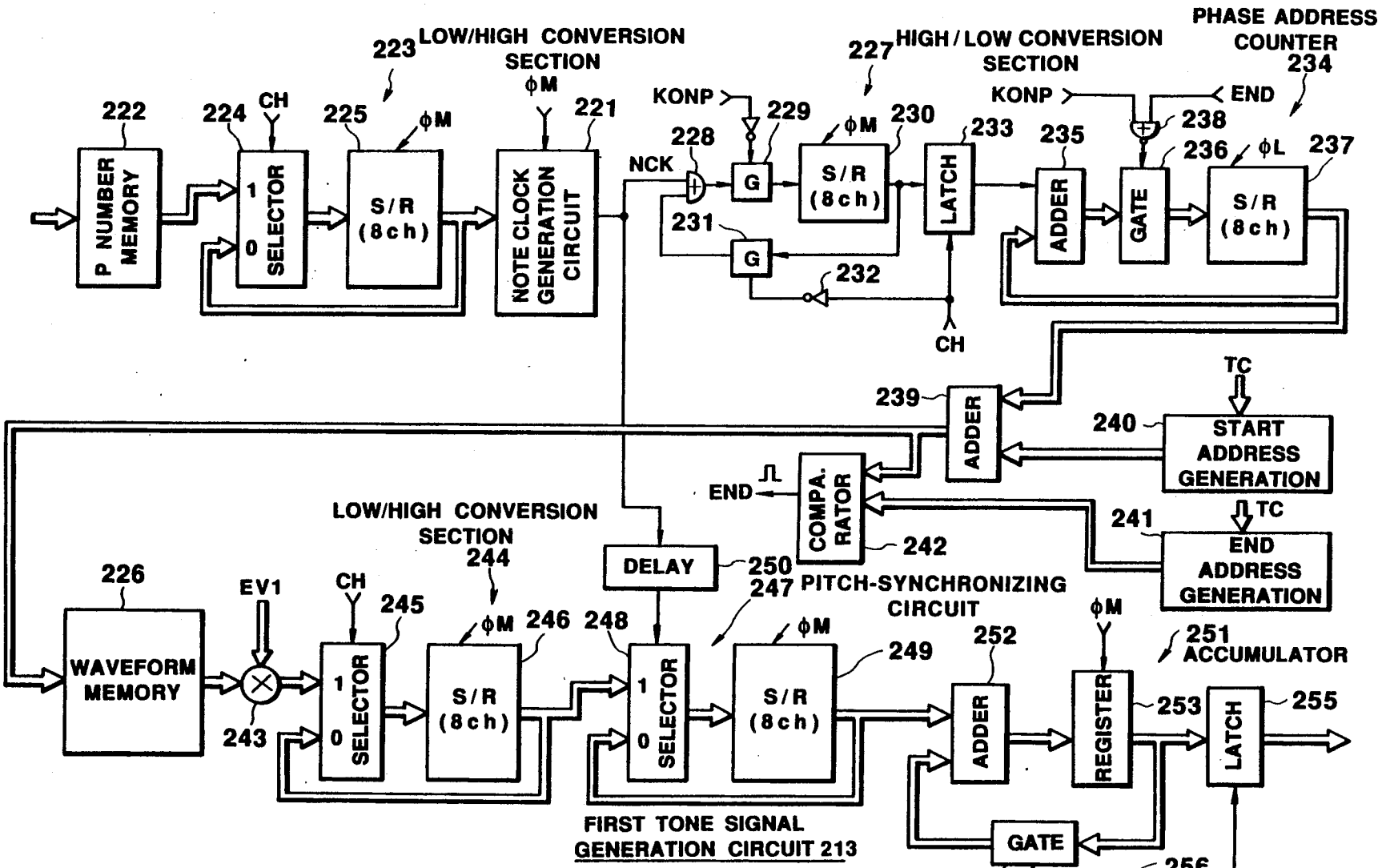
FIG. 15 is a block diagram showing a specific example of the first tone signal generation circuit (pitch synchronizing type) in the first tone signal generation circuit.

FIG. 15 shows a specific example of the first tone signal generation circuit 213. A P number memory 222 prestores P numbers of respective tone pitches. The key codes KC of the respective channels at the low rate time division timing Lch from the key assigner circuit 212 are applied to the P number memory 222 and the P numbers are read out in response to the tone pitches of these key codes KC. The read out P numbers are likewise signals of the low rate time division timing Lch.

A low/high conversion section 223 converts the time division timing of the P number read from the P number memory 222 to a high rate time division timing. This low/high conversion section 223 includes a selector 224 which receives the output of the P number memory 222 at a "1" input thereof and an eight-stage shift register 225 corresponding to the number of channels which is eight. The output of the shift register 225 is circulated through a "0" input of the selector 224. As a selection control signal for the selector 224, the channel synchronizing pulse CH (see FIG. 14) is applied and when this pulse CH is "1", the "1" input is selected whereas when the pulse CH is "0", the "0" input is selected. The shift register 225 is shift-controlled by the master clock pulse $\phi$ M.

The P number which is read out from the P number memory 222 at the channel 1 at the low rate timing is selected by the selector 224 when the channel synchronizing pulse CH is turned to "1" at the channel 1 at the high rate timing and is loaded in the shift register 225. Similarly, the P numbers read out at timings of the other channels 2 to 8 at the low rate timing are selected by the selector 224 when the pulse CH is turned to "1" at respectively corresponding timings of the channels 2 to 8 at the high rate and is loaded in the shift register 225. The P number loaded in the shift register 225 are held therein circulating therethrough via the "0" input of the selector 224 until the pulse CH is turned to "1" at a next high rate timing of the channel. Thus, the P numbers corresponding to the tone pitches of keys assigned to the channels 1 to 8 are loaded in the eight stages of the shift register 225 and are repeatedly delivered out at a period which is eight times as long as the master clock pulse $\phi$ M (i.e., at a period of the common sampling frequency fs1) while they are shifted in response to the master clock pulse $\phi$ M. Accordingly, the timing of the P number at each channel produced by the shift register 225 becomes a high rate time division timing as shown in the column of Hch in FIG. 14.

P number data of each channel which has been converted to the high rate time division timing is applied to the note clock generation circuit 221. The note clock generation circuit 221 performs a frequency dividing operation as described above in response to the P number applied and thereby generates the note clock pulse NCK having a frequency corresponding to the tone pitch of a tone assigned to each channel on a time shared basis in response to the high rate time division timing Hch.

The above explanation has been made on the assumption that the P number is stored in the memory 222 in correspondence to each individual tone pitch. Alternatively, P numbers only for twelve note names C to B in a certain reference octave may be stored in the memory 222 and the octave control may be made inside the note clock generation circuit 221.

As a tone source in the first tone signal generation circuit 213, a waveform memory 226 prestoring waveform data of plural tone waveforms corresponding to various tone colors is employed. For example, a full waveform from rising of a tone to the end thereof is stored in the waveform memory 226.

Since it is unnecessary to perform reading from this waveform memory 226 itself at a high rate time division timing, a processing for converting the time division rate of the note clock pulse NCK generated by the note clock generation circuit 221 to a low rate one is made by a high/low conversion section 227.

In the high/low conversion section 227, the note clock pulse NCK is supplied to a gate 229 via an OR gate 228. The gate 229 is controlled by a signal obtained by inverting the key-on pulse KONP supplied from the key assigner circuit 212 (FIG. 13) in accordance with the low rate time division timing and is disabled at the beginning of depression of a key and otherwise is abled. The output of the gate 229 is applied to a one-bit/eight-stage shift register 230 and is shifted therein in response to the master clock pulse $\phi$ M. The output of the shift register 230 is fed back to the input side via a gate 231, an OR gate 228 and the gate 229. The gate 231 is enabled by a signal obtained by inverting the channel synchronizing pulse CH by an inverter 232. On the other hand, the output of the shift register 230 is further applied to a latch circuit 233 where it is loaded at a timing of the channel synchronizing pulse CH.

By this construction, the note clock pulse NCK of each channel is temporarily stored in the shift register 230 and circulated in accordance with the high rate time division timing. In response to the channel synchronizing pulse CH generated in the manner shown in FIG. 14, the output of each channel of the shift register 230 is latched, channel by channel, by the latch circuit 233 at substantially the period of the low rate time division timing. When the output of the shift register 230 has been latched by the latch circuit 233, the gate 231 is closed to prohibit circulation of data and clear the contents of storage. On the other hand, data of a certain channel latched by the latch circuit 233 is also cleared at next occurrence of the channel synchronizing pulse CH. Accordingly, when the note clock pulse NCK of a certain channel is "1", this data "1" is held by the latch circuit 233 during nine or one period of the master clock pulse $\phi$ M from generation of the channel synchronizing pulse CH in synchronism with the high rate time division timing of the channel till next occurrence of this pulse CH.

A phase address counter 234 includes an adder 235 to which the output of the latch circuit 233 is applied, a gate 236 and an eight stage shift register 237 which is shift-controlled by the low rate clock pulse $\phi$ L. The output of the shift register 237 is supplied to the adder 235 and fed back to the input side thereof via the gate 236. A signal obtained by inverting the key-on pulse KONP is supplied to the gate 236 via the NOR gate 238 and the gate 236 thereby is disabled at the beginning of depression of a key and the old storage of the shift register 237 concerning the channel to which this key has been assigned is cleared.

The output of the latch circuit 233 is applied to the adder 235 where it is added to the output of the shift register 237. The result of the addition is stored in the shift register 237. This addition is made with a period which is eight times as long as the low rate clock pulse $\phi$ L concerning one channel. Since, on the other hand, time width during which data of a certain channel is produced from the latch circuit 233 is nine or one period of the master clock pulse $\phi$ M, the output of the latch circuit 233 is added to the output of the shift register 237 concerning the same channel only once. For example, the shift register 237 performs loading and shifting of data in synchronism with rising (change from "0" to "1") of the low rate clock pulse $\phi$ L. Thus, in the phase address counter 234, count value corresponding to a certain channel is increased by 1 each time one shot of the note clock pulse NCK is generated in correspondence to this channel.

The output of the phase address counter 234 is supplied as a relative phase address signal to an adder 239. The time division timing of the output of this phase address counter 234 is the low rate time division timing Lch as shown in FIG. 14.

The tone color data TC generated in accordance with the selected tone color is supplied to a start address generation circuit 240 and an end address generation circuit 241 and start address value data and end address value data indicating a memory address region corresponding to the tone color in the waveform memory 226 are provided by the circuits 240 and 241. The start address value data is supplied from the start address generation circuit 240 to the adder 239 and is added to a relative phase address signal provided by the phase address counter 234. The output of the adder 239 is applied to the address input of the waveform memory 226. The output of the adder 239 is supplied also to a comparator 242 and compared with the end address value data supplied from the end address generation circuit 241. When the two data coincide with each other, an end pulse END is produced. The end pulse END is supplied to the gate 236 via the NOR gate 238 to clear the count of the corresponding channel in the phase address counter 234.

Thus, the address value changes from the start address to the end address in response to the note clock pulse NCK and, in response thereto, waveform data for the full waveform from rising of the tone to the end thereof is sequentially read out from the waveform memory 226.

The waveform data read out from the waveform memory 226 is supplied to a multiplier 243 where it is multiplied with the envelope signal EV1 supplied from the envelope generator 219 (FIG. 13). A digital tone signal which has been envelope controlled and provided by the multiplier 243 in this manner is provided at the low rate time division timing signal Lch shown in FIG. 14.

The output of the multiplier 243 is applied to a low/-high concersion section 244 where it is converted to the high rate time division timing Hch. The low/high conversion section 244 includes, as the above described low/high conversion section 223, a selector 245 and an eight-stage shift register 246 and performs a similar operation to convert the time division timing of a tone signal to the high rate time division timing Hch.

A pitch synchronizing circuit 247 resamples tone waveform sample point amplitude data read out from the waveform memory 226 in synchronism with its tone pitch, i.e., pitch (this operation is called "pitch synchronizing operation"). This pitch synchronizing operation is performed in response to the note clock pulse NCK generated by the note clock generation circuit 221. It is therefore necessary to perform the pitch synchronizing operation in the pitch synchronizing circuit 247 at the high rate time division timing Hch similar to the note clock pulse NCK. For this purpose, the above described low/high conversion section 244 is provided to convert the tone waveform sample point amplitude data signal read out from the waveform memory 226 to the high rate time division timing Hch.

The pitch synchronizing circuit 247 includes a selector which receives the output of the shift register 246 at its "1" input and an eight stage shift register 249 which is shift controlled by the master clock pulse $\phi$ M. The output of the shift register 249 is fed back to the input side of the shift register 249 via the "0" input of the selector 248.

To a control input of the selector 248 is applied the note clock pulse NCK generated by the note clock generation circuit 221 via a delay circuit 250. When the note clock pulse NCK applied to the control input of the selector 248 is "1", the selector 248 selects the tone waveform sample point amplitude data supplied from the shift register 246 of the low/high conversion section 244 to the "1" input and otherwise selects the output of the shift register 249 supplied to the "0" input to hold the contents of the shift register 249 in circulation. The delay circuit 250 applies a delay for a period of time corresponding to a signal delay time in the other route through which the note clock pulse NCK is supplied, i.e., the route from the high/low conversion section 227 to the low/high conversion section 244 via the waveform memory 226.

When the note clock pulse NCK has been turned to "1" at a time slot of a certain channel at the high rate time division timing Hch, the tone waveform sample point amplitude data of the channel is selected by the selector 248 and stored in the shift register 249. Thus, the tone waveform sample point amplitude data of each channel provided by the shift register 249 of the pitch synchronizing circuit 247 changes in synchronism with the note clock pulse NCK of the channel whereby pitch synchronization is realized.

The output of the pitch synchronizing circuit 247, i.e., the output of the shift register 249, is supplied to an accumulator 251 where tone waveform sample point amplitude data for one sample point in the respective channels are summed together in the accumulator 251. The accumulator 251 includes an adder 252 receiving the output signal of the shift register 249, a register 253 for delaying the output signal of the adder 252 by one bit in response to the master clock pulse $\phi$M, a gate 254 for applying the output of this register 253 to the adder 252 and a latch circuit 255 for holding the output of the register 253. The gate 254 is controlled by a signal obtained by inverting the clock pulse CH1 (see FIG. 14) which synchronizes with the time slot of the first channel at the high rate time division timing Hch. The operation of the latch circuit 255 is controlled also by the clock pulse CH1.

The tone waveform sample point amplitude data for one sample point of the first to eighth channels sequentially supplied in accordance with the high rate time division timing Hch are sequentially accumulated and, when data of all channel have been accumulated, the clock pulse CH1 rises and the accumulated value of data of all channels is latched by the latch circuit 255 and the gate 254 is closed to clear the accumulated value in the register 253.

The output of the latch circuit 255 is provided as the output of the first tone signal generation circuit 213. In the foregoing manner, the sampling frequency fs1 of the output tone signal of the first tone signal generation circuit 213 becomes the sampling frequency 400 kHz at the high rate time division timing Hch and is also synchronized with the pitch of the tone signal.

A Specific Example of the Second Tone Signal Generation Circuit 214

Figure 16:
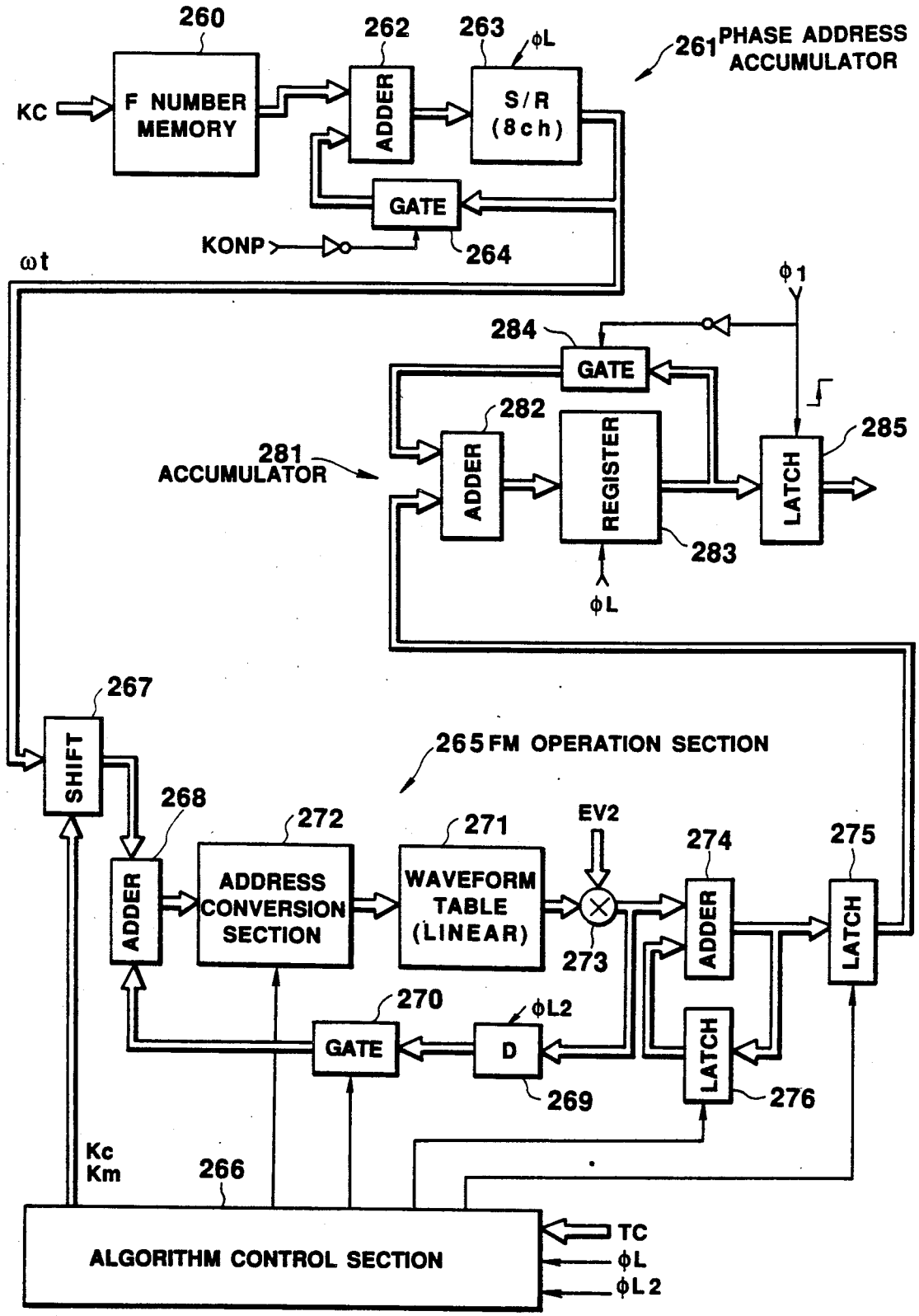
FIG. 16 is a block diagram showing a specific example of the second tone signal generation circuit (non-pitch-synchronizing type) in FIG. 13.

FIG. 16 shows a specific example of the second tone signal generation circuit 214. An F number memory 260 prestores F numbers of respective tone pitches. Key codes KC of respective channels supplied from the key assigner circuit 212 (FIG. 13) at the low rate time division timing Lch are applied to the F number memory 260 and F numbers are read out in correspondence to the tone pitches of the key codes KC. The F number is numerical data which is proportional to tone pitch frequency and corresponds to phase incremental value per unit time.

The read out F number is applied to a phase address accumulator 261. The phase address accumulator 261 repeatedly operates the F number at a regular time interval and generates a phase address signal corresponding to a phase angle $\omega$ t.

The phase address accumulator 261 includes an adder 262 which has received the F number from the memory 260, an eight stage shift register 263 which is shift controlled by the low rate clock pulse $\phi$ L and a gate 264. The output of the shift register 263 is applied to the adder 262 through the gate 264 and is fed back to the input side of the adder 262. A signal obtained by inverting the key-on pulse KONP is applied to the gate 264 whereby the gate 264 is disabled at the beginning of depression of a key and the old storage in the shift register 263 concerning the channel to which this key has been assigned is cleared.

The phase address signal $\omega$ t generated by the phase address accumulator 261 is supplied to a frequency modulation operation section 265. The frequency modulation operation section 265 executes a frequency modulation operation for synthesizing a tone.

The frequency modulation operation section 265 executes a frequency modulation operation in accordance with a predetermined operation algorithm by using an operation circuit of one system on a time shared basis by the control of an algorithm control section 266. In the illustrated example, the simplest one-term frequency modulation operation is executed on a time shared basis by using two time slots. Time division timing in each channel in the second tone signal generation circuit 214 is the low rate time division timing Lch as shown in FIG. 14. The time slot in each channel at the low rate time division timing Lch is divided into two by the clock pulse $\phi$ L2 (see FIG. 14) having a frequency which is twice as high as the lower rate clock pulse $\phi$ L. The operation for generating a modulating wave signal is executed in a former half time slot and the operation for generating a modulated wave signal (i.e., carrier signal) is executed in a latter half time slot.

Hardware structure of an operation circuit in the frequency modulation operation section 265 will now be described. A shift circuit 267 receives a phase address signal corresponding to the phase angle $\omega$ t from the phase address accumulator 261 and shifts this signal suitably by an amount corresponding to coefficient k to multiply an angular frequency $\omega$ by k. More specifically, frequency coefficient data kc of the carrier and frequency coefficient data km of the modulating wave are provided from the algorithm control section 266 at a proper timing and the shift amount is controlled in accordance with these data. In this manner, the output of the shift circuit 267 exhibits an instantaneous phase angle kc $\omega$ t of the carrier signal or an instantaneous phase angle km $\omega$ t of the modulating wave signal.

The adder 268 to which the output of the shift circuit 267 is applied is an adder for executing phase modulation. For executing phase modulation, a modulating signal is supplied from a delay circuit 269 through a gate 270 and added to the phase address signal corresponding to the phase angle. When the adder 268 does not execute the phase modulation, the modulating wave signal is not given but the phase address signal corresponding to the phase angle passes through the adder 268.

The output of the adder 268 corresponds to a phase address signal for accessing a waveform table 271. In this example, an address conversion section 272 is provided between the adder 268 and the waveform table 271.

The waveform table 271 stores waveform data of a predetermined waveform function, e.g., a sine function, in a linear expression.

The address conversion section 272 converts the address value of the phase address signal for each of plural sections defined by dividing a phase for one cycle in accordance with a function which is established section by section.

By accessing the waveform table 271 by the output of the address conversion section 272, waveform data of a waveform function which is different from a predetermined waveform function, e.g., sine function, stored in the waveform table 271 is provided from the waveform table 271 in response to the phase address signal. As a different waveform function, in this example, a function simulating a sine wave function, for example, is realized.

Particulars of this address conversion section 272 will be described later.

The output signal of the waveform table 271 is supplied to a multiplier 273 where it is multiplied by the envelope signal EV2 provided by the envelope generator 219 (FIG. 13). As this envelope signal EV2, as will be described later, an envelope signal corresponding to modulation index is supplied at the former half time slot and an envelope signal corresponding to amplitude coefficient is provided at the latter half time slot. The output of the multiplier 273 is delayed by the delay circuit 269 by one period of the clock pulse $\phi$ L2 (see FIG. 14), i.e., half of one channel time slot at the low rate time division timing Lch and thereafter is supplied to the adder 268. The output of the multiplier 273 is supplied to latch circuits 275 and 276 via an adder 274. The output of the latch circuit 276 is supplied to the adder 274. The latch circuit 275 is provided for holding result of the frequency modulation operation for one channel and performs a latch operation at the end of time slot of each channel at the low rate time division timing.

Figure 17:
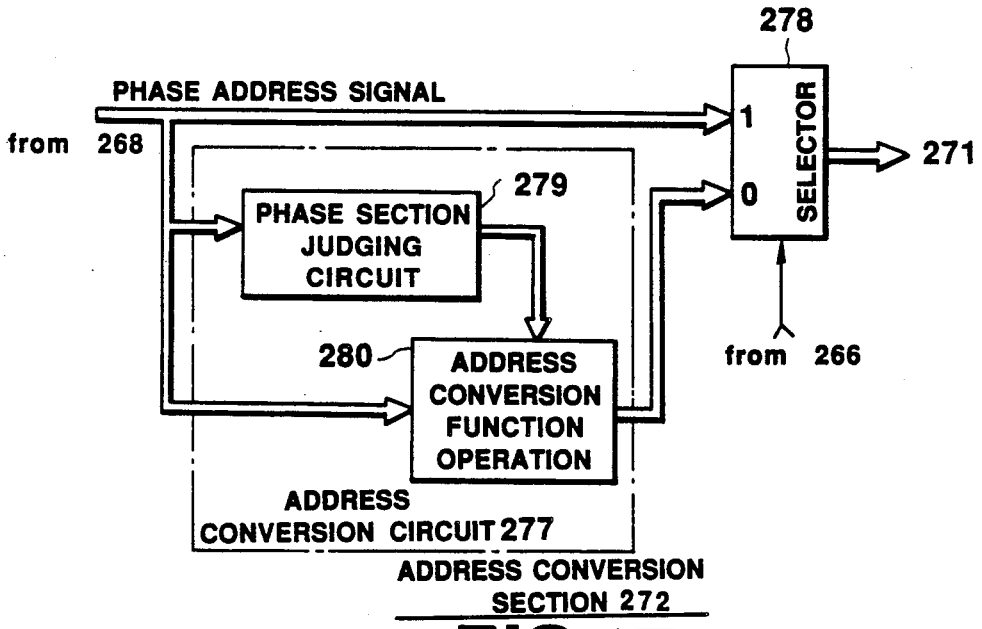
FIG. 17 is a block diagram showing an example of the address conversion section in FIG. 16.

A specific example of the address conversion section 272 is shown in FIG. 17. The address conversion section 272 includes an address conversion circuit 277 for performing an address conversion operation and a selector 278 for selecting either a converted address signal or an unconverted phase address signal. The address conversion circuit 277 includes a phase section judging circuit 279 for judging which phase section among plural sections in a phase of one cycle the address value falls in on the basis of the value of an input phase address signal and an address conversion function operation circuit 280 which has a plurality of address conversion functions which are established individually for each phase section, selects an address conversion function corresponding to a phase section judged by this phase section judging circuit 279 and performs an operation for converting the address value of the input phase address signal in accordance with the selected address conversion function.

Figure 18:
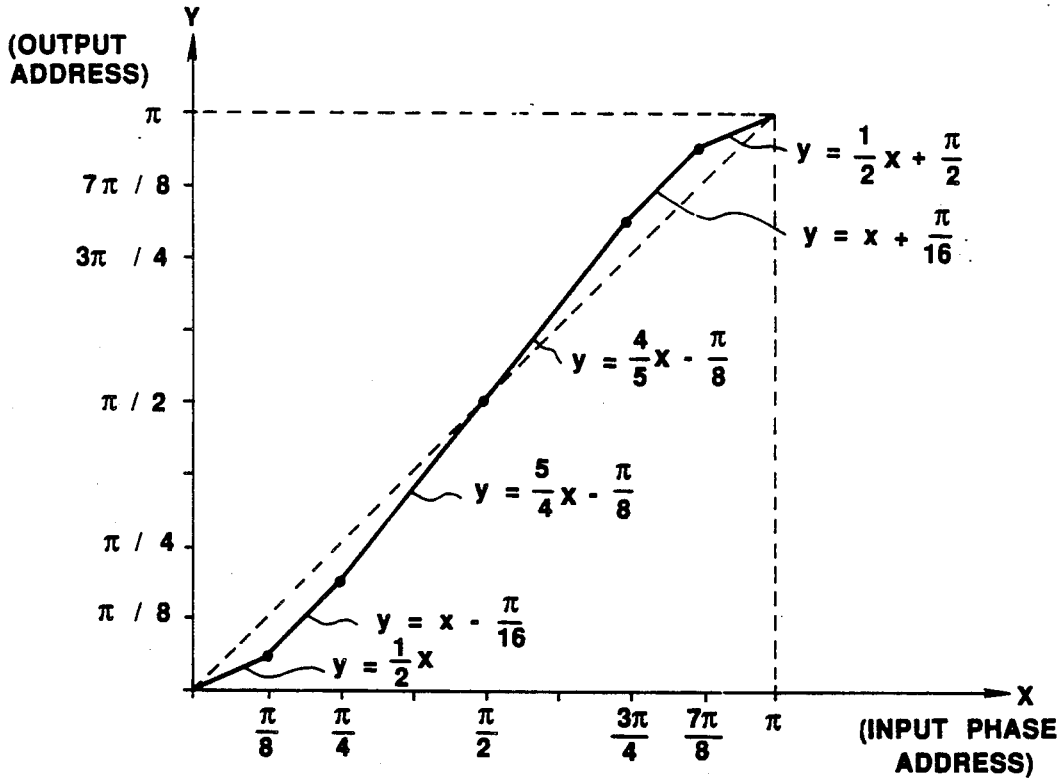
FIG. 18 is a graph showing an example of characteristics of address conversion function in the address conversion section.

An example of address conversion functions prepared in the address conversion function operation circuit 280 is shown in FIG. 18. In this example, a phase range of 0 to $\pi/8$ is divided into six phase sections 0 to $\pi/8$, $\pi/8$ to $\pi/4$, $\pi/4$ to $\pi/2$, $\pi/2$ to $3\pi/4$, $3\pi/4$ to $7\pi/8$, and $7\pi/8$ to $\pi$ and the following address conversion functions are prepared for each phase section. In FIG. 18 and the following address conversion functions, the independent variable x is a phase value of a phase address applied from the adder 268 and the dependent variable y is a phase value of the address signal after conversion provided by the address conversion function operation circuit 280. The inequality represents a condition of judgement in the phase section judging circuit 279.

(1) When $0 \leqq x < \pi/8$ $y = (1/2)\,x$ (2) When $\pi/8 \leqq x < \pi/4$ $y = x - \pi/16$ (3) When $\pi/4 \leqq x < \pi/2$ $y = (5/4)\,x - \pi/8$ (4) When $\pi/2 \leqq x < 3\,\pi/4$ $y = (5/4)\,x - \pi/8$ -continued (5) When $3\pi/4 \leqq x < 7\,\pi/8$ $y = x + \pi/16$ (6) When $7\pi/8 \leqq x < \pi$ $y = (1/2)\,x + \pi/2$ In a phase range of $\pi$ to $2\pi$ also, the phase range is divided into six phase sections $\pi$ to $\pi+\pi/8$, $\pi+\pi/8$ to $\pi+\pi/4$, $\pi+\pi/4$ to $\pi+\pi/2$, $\pi+\pi/2$ to $\pi+3/4$, $\pi+3\pi/4$ to $\pi+7\pi/8$, $\pi+7\pi/8$ to $2\pi$ in the same manner as described above and the same address conversion functions as described above are used for the respective phase sections.

Since each of the above address conversion function is a linear function, the structure of the address conversion function operation circuit 280 can be substantially simplified. The address conversion function corresponding to each phase section in the address conversion function operation circuit 289 however is not limited to a linear function but may be a secondary function or other type of function.

The selector 278 is controlled by a selection control signal supplied from the algorithm control section 266 to select either an unconverted phase address signal or an address signal which has been converted by the address conversion circuit 277 and supply the selected signal to the waveform table 271. The waveform table 271 therefore is accessed selectively by either the unconverted phase address signal or the converted address signal.

Figure 19A:
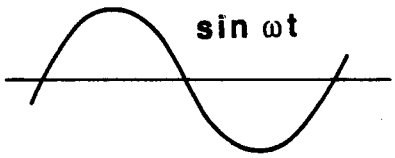
Figure 19B:
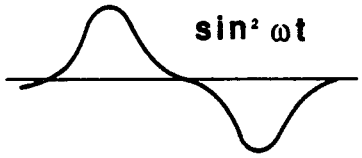

If the phase of the unconverted phase address signal is designated by $\omega t$ and a sine function is stored in the waveform table 271, a sine wave function sin $\omega t$ is obtained by accessing the waveform table 271 by the unconverted phase address signal (see FIG. 19*a*). If, on the other hand, the waveform table 271 is accessed by the address signal as in the above described example (i.e., FIG. 18) which has been converted by using the address conversion function, a waveform function $\sin^2 \omega t$ simulating a $\sin^2$ wave function is obtained (see FIG. 19*b*).

Thus, by using the waveform table 271 storing waveform data in the form of a linear expression of a sine wave function, two types of waveform functions, i.e., a sine wave function (sin $\omega t$) as stored in the waveform table 271 and a waveform function simulating a $\sin^2$ wave function ($\sin^2$ 107 t) which is different from the sine wave function, can be selectively produced.

If, as is well known, a waveform of a former half period and one of a latter half period are symmetrical as sine wave function, it is not necessary to cause a full waveform of the entire period to be stored in the waveform table 271 but a half period waveform or a quarter period waveform has only to be stored in the waveform table 271. In that case, controls for changing the forward/reverse direction for accessing the waveform table 271 depending upon the phase range and inverting the positive and negative signs of read out waveform data are performed. Since these controls are well known in the art, description and illustration thereof will be omitted.

The address conversion function prepared in the address conversion function operation circuit 280 is not limited to one which can realize a waveform function simulating the above described $\sin^2$ wave function ($\sin^2 \omega t$) but may be one which can realize other waveform function in simulation.

The address conversion function prepared in the address conversion function operation circuit 280 is not limited to a set of functions which can realize one kind of waveform function in simulation but may be plural sets of functions which can realize plural kinds of waveform functions in simulation and one kind of waveform function among them may be selected as desired.

As the address conversion function operation circuit 280, not only an arithmetic operation circuit but also a memory circuit such as a function table may be employed.

The waveform function stored in the waveform table 271 is not limited to a sine wave function but may be a cosine wave function or any other desired waveform function. In that case, characteristics of the address conversion function in the address conversion function operation circuit 280 should be determined having regard to the waveform stored in the waveform table 271 and a desired waveform function to be realized.

The manner of dividing the phase section is not limited to the above described one but any other method may be employed as desired.

An example of operation algorithm in the frequency modulation operation section 265 using two time slots per channel will now be described. There are the following eight possible operation algorithms. One algorithm among them is selected in the algorithm control section 266 in response to the tone color data TC and various control signals and operation parameters for realizing the selected algorithm are supplied to the respective circuits in the frequency modulation operation circuit 265.

Algorithm 1 . . . $E(t)\sin\{kc\omega t + Em(t)\sin(km\omega t)\}$
Algorithm 2 . . . $E(t)\sin\{kc\omega t + Em(t)\sin^2(km\omega t)\}$
Algorithm 3 . . . $E(t)\sin^2\{kc\omega t + Em(t)\sin(km\omega t)\}$
Algorithm 4 . . . $E(t)\sin^2\{kc\omega t + Em(t)\sin^2(km\omega t)\}$
Algorithm 5 . . . $E(t)\sin(kc\omega t) + Em(t)\sin(km\omega t)$
Algorithm 6 . . . $E(t)\sin(kc\omega t) + Em(t)\sin^2(km\omega t)$
Algorithm 7 . . . $E(t)\sin^2(kc\omega t) + Em(t)\sin(km\omega t)$
Algorithm 8 . . . $E(t)\sin^2(kc\omega t) + Em(t)\sin^2(km\omega t)$ E(t) represents an envelope signal for establishing an amplitude envelope and Em(t) represents an envelope signal for establishing a modulation index. These envelope signals E(t) and Em(t) are functions of time so that they change with time. These envelope signals E(t) and Em(t) are included in the envelope signal EV2 for the second tone signal generation circuit 214 and the envelope signal Em(t) for establishing the modulation index is provided at the former half of a time slot for one channel whereas the envelope signal E(t) for establishing the amplitude envelope is provided at the latter half of the time slot.

Processings for generating a modulating wave function (an operation of the second term of the above described equation, i.e., the term in which the coefficient Em(t) is multiplied) are performed at the former half of the time slot for one channel whereas processings for generating a carrier function and performing the modulation operation (an operation of the first term of the above described equation, i.e., the term in which the coefficient E(t) is multiplied) are performed at the latter half of the time slot.

By way of example, the operation of the above algorithm 2 will be described. At the former half of a time slot for one channel, the modulating wave frequency coefficient km is supplied to the shift circuit 267, a control signal for selecting the converted address signal to the address conversion section 272 and the envelope signal Em(t) as the envelope signal EV2 to the multiplier 273, respectively, and a modulating wave function signal having characteristics of Em(t) $\sin^2$ (km $\omega$t) in simulation is provided through the waveform table 271 and the multiplier 273. This modulating wave function signal is delayed by the delay circuit 269 and supplied to the gate 270 at the latter half time slot.

At the latter half time slot, the carrier frequency coefficient kc is supplied to the shift circuit 267, a control signal for selecting the unconverted phase address signal to the address conversion section 272, a control signal for enabling the gate 270 to the gate 270 and the envelope signal Em(t) as the envelope signal EV2 to the multiplier 273, respectively. The modulating wave function signal Em(t)$\sin^2$ (km $\omega$t) is thereby added by the adder 268 to the carrier phase angle data kc $\omega$t to effect phase modulation. A resulting phase-modulated phase address signal passes through the address conversion section 272 without conversion and accesses the waveform table 271. The read out output signal from the waveform table 271 is multiplied with the amplitude envelope signal E(t) whereby tone signal sample point amplitude data which is a result of the frequency modulation operation shown in the above algorithm 2 is obtained. This data passes through the adder 274 and is supplied to the latch circuit 275. A latch control pulse is supplied to the latch circuit 275 at a suitable timing at the end of the latter half time slot to latch the tone signal sample point amplitude data which is a result of the frequency modulation operation shown in algorithm 2 in the latch circuit 275.

The above described algorithms 1 to 4 are used virtually for frequency modulation operation and algorithms 5 to 8 are used for adding and synthesizing two waveform signals together. In case of conducting such addition and synthesis of two waveform signals, a latch control pulse is supplied to the latch circuit 276 at a suitable timing at the former half of a time slot for one channel to latch waveform sample data (Em(t) sin km $\omega$t etc.) which have been operated at the former half time slot in the latch circuit 276. At the latter half of the time slot for one channel, the gate 270 is not enabled, i.e., phase modulation is not performed, but waveform sample point amplitude data (E(t) sin kc $\omega$t etc.) obtained by multiplying the read out signal from the waveform table 271 with the amplitude envelope signal E(t) is added to waveform sample point amplitude data (Em(t) sin km $\omega$t etc.) from the latch circuit 276 by the adder 274. The result of addition is latched by the latch circuit 275 at a suitable timing at the end of the latter half time slot.

In a case where the addition and synthesis as shown by the algorithms 5 to 8 is performed, the gate 270 may be enabled, i.e., phase modulation may be performed, at the latter half of a time slot for one channel. By doing so, a tone signal which consists of a tone signal of the frequency modulation operation algorithm of the above described algorithms 1 to 4 added with a modulating wave signal is synthesized.

The output of the latch circuit 275 is applied to an accumulator 281 where tone waveform sample point amplitude data for one sample point is summed. The accumulator 281 includes an adder 282 for receiving the output signal of the latch circuit 275, a register 283 for delaying the output of the adder 282 by one bit time in response to the low rate clock pulse $\phi$L, a gate 284 for applying the output of this register 283 to the adder 282 and a latch circuit 285 for holding the output of the register 283. The gate 284 is controlled by a signal obtained by inverting, by an inverter 282, the clock pulse $\phi 1$ (see FIG. 14) which is synchronized with the time slot of the first channel at the low rate time division timing Lch. The latch operation of the latch circuit 285 is also controlled by this clock pulse $\phi 1$.

Tone waveform sample point amplitude data for one sample point of the first to eighth channels which is sequentially supplied at the low rate time division timing Lch is sequentially accumulated and, when data of all channels have been accumulated, the clock pulse $\phi 1$ rises whereby the accumulated value of the data of all channels is latched by the latch circuit 285 and, simultaneously, the gate 284 is closed and the accumulated value in the register 283 is cleared.

The output of the latch circuit 285 is provided as the output of the second tone signal generation circuit 214. In this manner, the sampling frequency fs2 of the output tone signal of the second tone signal generation circuit 214 becomes the sampling frequency 50 kHz at the low rate time division timing Lch. In this second tone signal generation circuit 214, no particular pitch synchronizing processing is performed so that the pitch of the output tone signal and the sampling frequency fs2 thereof are asynchronous with each other.

Digital Addition and Synthesis

Reverting to FIG. 13, as described above, the output tone signal of the first tone signal generation circuit 213 and the output tone signal of the second tone signal generation circuit 214 are added and synthesized together in the adder 215. The sampling frequency fs1 of the output tone signal of the first tone signal generation circuit 213 is 400 kHz and the sampling frequency fs2 of the output tone signal of the second tone signal generation circuit 214 is 50 kHz so that the former is integer multiple of the latter. Accordingly, the sampling frequencies of the two tone signals to be added together are synchronized and, therefore, the two signals can be added together without any problem at a harmonized timing.

Envelope Generator 219

Figure 20:
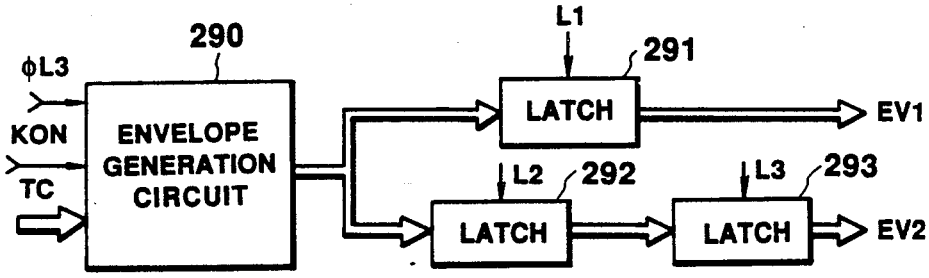
FIG. 20 is a block diagram showing an example of the envelope generator in FIG. 13.

An example of the envelope generator 219 is shown in FIG. 20. In FIG. 20, the envelope generator 219 includes an envelope generation circuit 290 which generates, in time division multiplexing, the first envelope signal EV1 for the tone signal generated in the first tone signal generation circuit 213 and the second envelope signal EV2 for the tone signal generated in the second tone signal generation circuit 214 and latch circuits 291, 292 and 293 for distributing the envelope signals EV1 and EV2 generated in time division multiplexing.

The envelope generation circuit 290 generates, on a time shared basis, the first envelope signal EV1 for eight channels for the first tone signal generation circuit 213 and the second envelope signal EV2 for eight channels for the second tone signal generation circuit 214 (this envelope signal consists, as described before, of the two envelope signals E(t) and Em(t) per one channel), in twentyfour channels in total. The time division timing for the twentyfour channels in this envelope generation circuit 290 is established by the clock pulse $\phi$ L3 (see FIG. 14) having a frequency which is three times as high as the low rate clock pulse $\phi$ L. By this clock pulse $\phi$ L3, time division timing Ech (see FIG. 14) for forming an envelope which timing is provided by dividing the time slot of each channel of the low rate time division timing Lch is established.

The envelope generation circuit 290 generates, in response to the key-on signal KON of each channel supplied from the key assigner circuit 212 in synchronism with the low rate time division timing Lch, three different envelope signals EV1, E(t) and Em(t) at three time slots determined by dividing one channel by three. The shape and level of the respective envelope signals EV1, E(t) and Em(t) are determined by the tone color data TC.

For example, among the time slots obtained by dividing one channel by three, the first envelope signal EV1 is generated at the first time slot, the envelope signal Em(t) of the second envelope signal EV2 is generated at the second time slot and the envelope signal E(t) of the second envelope signal EV2 at the third time slot. Data expression of these envelope signals EV1, Em(t) and E(t) are assumed to be linear expression.

The output of the envelope generation circuit 290 is supplied to the latch circuits 291 and 292. The latch circuit 291 latches the first envelope signal EV1 for each channel in response to a strobe pulse L1 (see FIG. 14) which is generated in synchronism with the first time slot of the three-divided time slots. The latch circuit 292 latches the two second envelope signals Em(t) and E(t) for each channel in response to strobe pulses L2 (see FIG. 14) which are generated in synchronism with the second and third time slots among the three-divided time slots. The output of the latch circuit 293 is applied to a latch circuit 293. The latch circuit 293 is latch controlled by a strobe pulse L3 (see FIG. 14) which is synchronized with a clock pulse $\phi$ L2 (see FIG. 14) having a frequency which is twice as high as the low rate clock pulse $\phi$ L and thereby shapes the time division time slot of the two envelope signals Em(t) and E(t) for each channel at equal intervals.

In this manner, the latch circuit 291 produces, on a time shared basis, the first envelope signal EV1 for each channel in synchronism with the low rate time division timing Lch. The output EV1 of the latch circuit 291 is subjected to a proper timing matching processing and thereafter is supplied to the multiplier 243 (FIG. 15) in the first tone signal generation circuit 213. The latch circuit 293 produces, on a time shared basis, the two envelope signals Em(t) and E(t) for each channel at a time division rate which is twice as high as the low rate time division timing Lch. The outputs Em(t) and E(t) from the latch circuit 293 are subjected to a proper timing matching processing and thereafter is supplied to the multiplier 273 (FIG. 16) in the second tone signal generation circuit 214 (FIG. 16) as the second envelope signal EV2.

The waveform table 271 in the second tone signal generation circuit 214 may store waveform data in logarithmic expression. This however requires the envelope signal EV2 to be provided in logarithmic expression also. In that case, the hardware of the envelope generator 219 cannot be used commonly for the first and second envelope signals EV1 and EV2 so that it is impossible to generate these envelope signals EV1 and EV2 on a time shared basis. The hardware of the envelope generator 219 therefore would become large.

If, however, waveform data is stored in linear expression in the waveform table 271 in the second tone signal generation circuit 214, the envelope signal EV2 may also be provided in linear expression. In that case, as in the above described embodiment, the hardware of the envelope generator 219 can be used commonly for the first and second envelope signals EV1 and EV2 so that these envelope signals EV1 and EV2 can be generated on a time shared basis. The hardware of the envelope generator 219 can therefore be made compact.

Even in a case where waveform data is stored in linear expression in the waveform table 271 of the second tone signal generation circuit 214, the provision of the address conversion section 272 as shown in the above described embodiment will enable a waveform function which is different from the waveform function stored in the waveform table 271 to be produced with a simple circuit construction.

The structure of the envelope generator 219 is not limited to the one shown in FIG. 20 but any other structure may be employed. For example, the first and second envelope signals EV1 and EV2 may be generated in parallel by separate hardwares. In a case where waveform data is stored in logarithmic expression in the waveform table 271 of the second tone signal generation circuit 214, the envelope signal EV2 may also be generated as data in logarithmic expression.

Example of Structure of Integrated Circuit Chip of the First and Second Tone Signal Generation Circuits 213 and 214

The first and second tone signal generation circuits 213 and 214 can be constructed by integrated circuits. In that case, it is possible to form the tone signal generation circuit 213 which is of the pitch synchronizing type and the tone signal generation circuit 214 which is of the non-pitch-synchronizing type on the same integrated circuit chip. One reason is that a partial common use of various timing clock pulses can be realized by establishing the integer multiple relationship between the sampling frequencies fs1 and fs2 and this contributes to simplification of the circuit design. Another reason is that generation of the envelope signals EV1 and EV2 in time division multiplexing by using a common hardware contributes to simplification of the circuit design.

For example, the first and second tone signal generation circuits 213 and 214, adder 215, envelope generator 219 and timing signal generation circuit 220 may advantageously be formed as a tone generator unit on the same integrated circuit chip. Alternatively, the first and second tone signal generation circuits 213 and 214 and adder 215 may be formed on the same integrated circuit chip.

Other Embodiments

Figure 21:
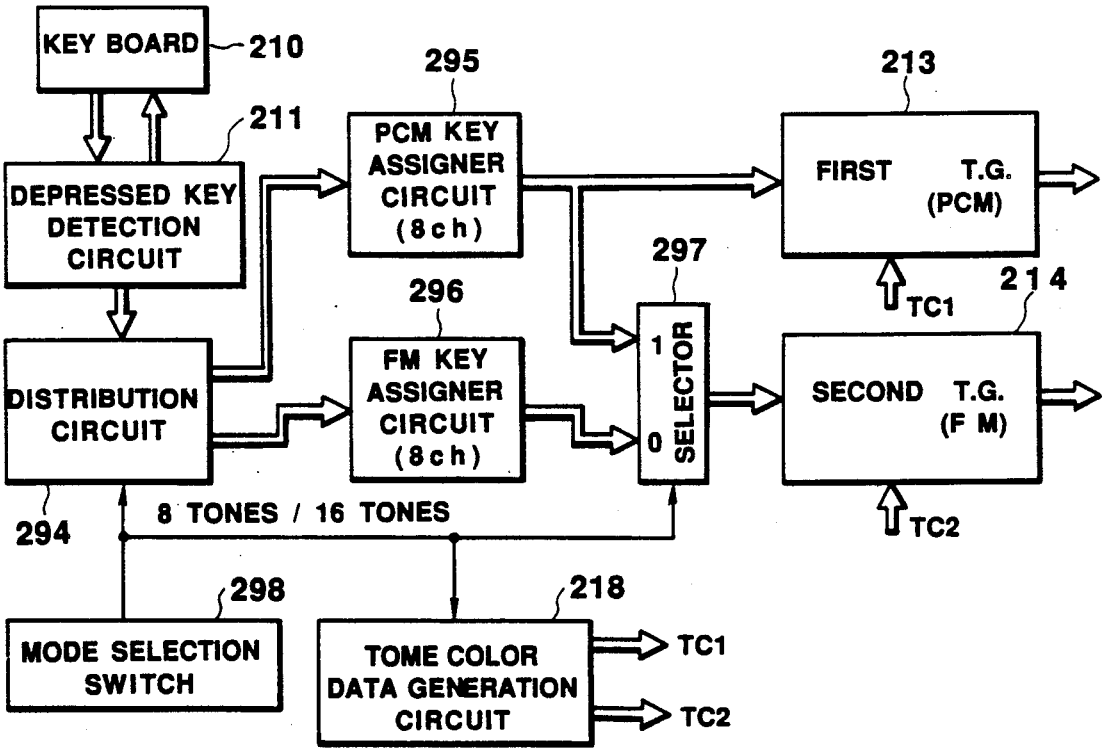
FIG. 21 is a block diagram showing schematically still another embodiment of the electronic musical instrument of the invention with respect to a modified portion in FIG. 13.

FIG. 21 shows an embodiment in which the two tone signal generation circuits 213 and 214 are used not only for generating tone signals of a common pitch but for other purposes whereby the two tone signal generation circuits 213 and 214 can be utilized more effectively. In FIG. 21, only a portion which has been modified from the embodiment of FIG. 13 is shown and illustration of a portion which is the same as the embodiment of FIG. 13 is omitted.

In FIG. 21, a distribution circuit 294, a PCM key assigner circuit 295, an FM key assigner circuit 296 and a selector 297 are provided in place of the key assigner circuit 212 of FIG. 13. Additionally, there is provided a mode selection switch 298.

In the embodiment of FIG. 21, an eight-tone mode and a sixteen-tone mode can be selected as desired. The mode selection switch 298 is provided for selecting either one of these two modes. The eight-tone mode means the same tone generation mode as is used in the embodiment of FIG. 13, i.e., a mode in which generation of tone signals having a common tone pitch is assigned to the first and second tone signal generation circuits 213 and 214. The maximum number of tones which can be sounded simultaneously in the electronic musical instrument, therefore, is eight tones in this mode. The sixteen-tone mode is a mode in which generation of tones having different tone pitches (different scales) from each other is assigned to the first tone signal generation circuit 213 and the second tone signal generation circuit 214. The maximum number of tones which can be sounded simultaneously in the electronic musical instrument, therefore, is eight tones plus eight tones, totalling sixteen tones in this mode.

By way of example, the keyboard 210 is constructed as a one-stage keyboard. In the case of the eight-tone mode, the entire key range of the one-stage keyboard is used for a common tone color. In the case of the sixteen-tone mode, the one-stage keyboard is divided into two key ranges and tones can be generated with tone colors which differ from each other between the key ranges. The distribution circuit 294 distributes key depression information provided from the depressed key detection circuit 211 either to the PCM key assigner circuit 295 and the FM key assigner circuit 296. The mode of distribution is determined by a mode selected by the mode selection switch 298. The PCM key assigner circuit 295 and the FM key assigner circuit 296 perform key assigning processing for eight channels. The output signals of the key assigner circuits 295 and 296 include, in the same manner as described before, the key code KC, key-on signal KON and key-on pulse KONP. The output of the PCM key assigner circuit 295 is supplied directly to the first tone signal generation circuit 213 and also to a "1" input of the selector 297. The output of the FM key assigner circuit 296 is supplied to a "0" input of the selector 297. The selector 297 is controlled for its selection in accordance with a mode selected by the mode selection switch 298. More specifically, the "1" input is selected in the eight-tone mode and the "0" input is selected in the sixteen-tone mode. The output of the selector 287 is supplied to the second tone signal generation circuit 214.

In case the eight-tone mode has been selected, the distribution circuit 294 distributes all key depression information to the PCM key assigner circuit 295 so that generation of tones corresponding to all depressed keys is assigned to any one of the eight channels in the PCM key assigner circuit 295. The selector 297 selects the "1" input so that the output of the PCM key assigner circuit 295 is supplied to the second tone signal generation circuit 214. Accordingly, the same output of the PCM key assigner circuit 295 is supplied to the first and second tone signal generation circuits 213 and 214 so that the two tone signal generation circuits 213 and 214 generate tone signals in accordance with the same data assigned thereto.

In case the sixteen-tone mode has been selected, the distribution circuit 294 divides the keyboard into two key ranges and distributes key depression information of one key range to the PCM key assigner circuit 295 and key depression information of the other key range to the FM key assigner circuit 296. Accordingly, generation of the tone corresponding to the depressed key in said one key range is assigned to any one of the eight channels int he PCM key assigner circuit 295 and generation of the tone corresponding to the depressed key in the other key range is assigned to any of eight channels of the FM key assigner circuit 296. The selector 297 selects the "0" input so that the output of the FM key assigner circuit 296 to the second tone signal generation circuit 214. Accordingly, different outputs of the key assigner circuits 295 and 296 are supplied to the first and second tone signal generation circuits 213 and 214 so that the two tone signal generation circuits 213 and 214 generates tone signals in accordance with data which are entirely different from each other.

The tone color data generation circuit 218 supplies different tone color data TC1 and TC2 to the first and second tone signal generation circuits 213 and 214. When the eight-tone mode has been selected, the tone color data TC1 and TC2 are of the same contents whereas when the sixteen-tone mode has been selected, the tone color data TC1 and TC2 exhibit tone colors selected in accordance with their corresponding key ranges.

In the embodiment of FIG. 21, the outputs of the first and second tone signal generation circuits 213 and 214 may be sounded through different sound systems without being digitally added together.

Modified Examples

The tone source system or tone signal generation system in the first and second tone signal generation circuits 213 and 214 is not limited to the above described one but any other system may be employed. For example, the waveform stored in the waveform memory of the first tone signal generation circuit 213 is not limited to a full waveform from rising of a tone to the end thereof but it may be a partial wave form including a rise portion of a tone and a sustain portion. The coding system of data stored in the waveform memory is not limited to PCM (pulse-code modulation) but it may be other suitable one selected from coding systems such as DPCM (difference PCM), ADPCM (adaptive difference PCM), DM (delata moudulation) and ADM (adaptive delta modulation). Algorithm of the frequency modulation operation in the second tone signal generation circuit 214 is not limited to the one used in the above described embodiment but other suitable modulation operation such as an amplitude modulation operation or an amplitude modulation operation using a time window may be employed. Further, a tone synthesis system other than the modulation operation type tone synthesis system may be employed.

The number of tone generation channels and sampling frequencies fs1 and fs2 re not limited to numerical values shown in the above described embodiments. The tone signal generation circuits 213 and 214 may be a monotone generation type circuit.

In the case where tone signals of a common tone pitch are simultaneously generated in the first and second tone signal generation circuits 213 and 214 to obtain a duet effect, generation of the two tone signals need not be started exactly simultaneously but there may be sone delay between starting of generation of the two tones. Further, the delay time in starting the tone generation may be variably controlle.

Instead of digitally adding the outputs of the first and second tone signal generation circuits 213 and 214 together, the outputs of these circuits may be sounded through sound systems of separate systems.

In case the tone signal generation circuit is utilized as a tone signal synthesis device of a modulation operation type, the tone signal generation circuit 214 of the modulation operation type only may be provided and the provision of the first tone signal generation circuit 213 may be omitted.

As will be apparent from the foregoing description, according to the invention, the delay duet effect, i.e., the effect of delaying start of generation of a tone signal in one of the first and second tone signal generation circuits with respect to start of generation of a tone signal in the other circuit, can be realized and the key scaling control, i.e., the variable control of the delay time in accordance with the tone pitch of a tone to be generated, can be performed whereby various controls such as equalizing the impression of delay in accordance with the tone pitch and, conversely, differring the impression of delay greatly in accordance with the tone pitch can be realized.

Further, according to the invention, various controls can be realized, e.g., smooth switching of tone signal generation from one tone signal generation circuit to the other can be realized by performing the control in which a tone signal is first generated in one of the first and second tone signal generation circuits and then generation of a tone signal is switched to the other tone signal generation circuit and a preceding tone is gradually attenuated while a succeeding tone is caused to rise gradually during the switching period and, besides, the key scaling control, i.e., the variable control of the switching period in accordance with the tone pitch of a tone to be generated, can be realized whereby equalizing of the impression of switching of a tone signal can be realized in accordance with the tone pitch and, conversely, differing of the impression of switching can be realized in accordance with the tone pitch.

Since, further, the tone generation mode designating the combination of tone generation in the first and second tone signal generation circuits can be selectively switched, various performance effects such as the duet effect and the delay duet effect can be selectively realized by switching the tone generation mode.

Thus, according to the invention, a tone synthesis system in which various controls can be performed is realized and rich performance effects can be achieved.

Further, according to the invention, by adopting the structure comprising two tone signal generation circuits and having output tone signals of the two circuits added and synthesized wherein one of the tone signal generation circuit is of a pitch synchronizing type circuit and the other is of a non-pitch-synchronizing type circuit, an aliasing noise which is not harmonic with the pitch can be excluded from a tone signal generated in the tone signal generation circuit of the non-pitch synchronizing type whereby a tone of a high quality can be synthesized.

Further, by suitably adding and synthesizing output tone signals of two tone signal generation circuits, various performance effects including the duet effect can be obtained.

Since the sampling frequencies of the two tone signal generation circuits are in integer multiple relationship, a part of various clock signals can be used commonly in both of the pitch synchroinizing type and non-pitch-synchronizing type tone signal generation circuits whereby the structure of circuits relating to clock signals can be simplified and, in addition thereto, synchronous operations of the two tone signal generation circuits are facilitated, which is advantageous to the digital addition of the output tone signals of the two tone signal generation circuits. This is also advantageous in a case where the pitch synchronizing type and non-pitch-synchronizing type tone signal generation circuits are formed on the same integrated circuit chip.

Further, according to the invention, tone signals of the same designated tone pitch may be generated in the two tone signal generation circuits or tone signals of different designated tone pitches may be generated depending upon the selected mode so that the duet effect and the optimum tone synthesis effect matching the tone generation stage can be obtained in the former mode whereas the number of tones which can be generated simultaneously can be increased in the latter mode so that the tone signal generation circuits can be utilized more effectively in various modes.

Further, according to the invention, in a tone signal synthesis device of a modulation operation type, an address value of a phase address signal for each of phase sections provided by dividing a phase of one period into plural sections is converted in accordance with a function established individually for each of the phase sections and a waveform table is accessed with the converted address signal. A modulating wave function or a modulated wave function in the tone synthesis modulation operation can therefore be converted easily to a complex waveform function which is different from a waveform function which is stored in the waveform table whereby a high quality tone synthesis modulation operation capable of controlling many frequency components with a relatively simple construction can be realized.

What is claimed is:

1. An electronic musical instrument comprising:

tone pitch designation means for designating a tone pitch of a tone to be generated;

first tone signal generation means for generating, in accordance with a first tone generating technique, a tone signal having a pitch corresponding to the tone pitch designated by said tone pitch designation means;

second tone signal generation means for generating, in accordance with a second tone generating technique which is different from the first technique a tone signal having a pitch corresponding to the tone pitch designated by said tone pitch designation means;

delay means for delaying a start of generation of a tone signal in one of said first and second tone signal generation means with respect to start of generation of a tone signal in the other tone signal generation means; and key scaling means for variably controlling delay time in said delay means in accordance with the tone pitch of a tone to be generated.

2. An electronic musical instrument as defined in claim 1 wherein a key scaling delay amount versus tone pitch characteristic of said key scaling means is selected from plural characteristics.

3. An electronic musical instrument as defined in claim 2 wherein said key scaling characteristic is selected in accordance with a tone color.

4. An electronic musical instrument as defined in claim 1 wherein said delay means starts a counting operation from start of generation of a preceding tone and causes generation of a succeeding tone to start when a count value has reached a predetermined value, and said key scaling means variably controls a count rate of the counting operation in accordance with the tone pitch.

5. An electronic musical instrument comprising:

tone pitch designation means for designating a tone pitch of a tone to be generated;

first tone signal generation means for generating, in accordance with a first tone generating technique, a tone signal having a pitch corresponding to the tone pitch designated by said tone pitch designation means;

second tone signal generation means for generating a tone signal having a pitch corresponding to the tone pitch designated by said tone pitch designation means in accordance with a second tone generating technique which is different from the first tone generation technique;

crossfade control means for performing a control in which a tone signal is first generated in one of said first and second tone signal generation means and then generation of a tone signal is switched to the other tone signal generation means, and a preceding tone is gradually attenuated while a succeeding tone is caused to rise gradually during the switching period; and key scaling means for variably controlling time length of said switching period in said crossfade control means in accordance with the tone pitch of a tone to be generated.

6. An electronic musical instrument as defined in claim 5 wherein a key scaling crossfade time length versus pitch characteristic of said key scaling means is selected from plural characteristics.

7. An electronic musical instrument as defined in claim 6 wherein said key scaling characteristic is selected in accordance with a tone color.

8. An electronic musical instrument comprising:

tone pitch designation means for generating tone pitch designation information designating a tone pitch of a tone to be generated;

first tone signal generation means for (d) generating a tone signal having a pitch which is determined by said tone pitch designation information, said tone signal being comprised of plural samples and being generated in accordance with an effective sampling frequency which is synchronized with said pitch and (b) outputting the tone signal at a sampling timing based on a common first sampling frequency;

second tone signal generation means for generating a tone signal comprised of plural samples and having a pitch which is determined by said tone pitch designation information and outputting samples of the tone signal at a second sampling frequency which is asynchronous with this pitch, said first and second sampling frequencies being in an integer multiple relation to each other;

digital addition means for adding the output tone signals of said first and second tone signal generation means together; and digital-to-analog conversion means for converting an output tone signal of said digital addition means to an analog signal.

9. An electronic musical instrument as defined in claim 8 further comprising envelope generation means for generating, in a time division multiplexing manner, a first envelope signal for the tone signal generated by said first tone signal generation means and a second envelope signal for the tone signal generated by said second tone signal generation means.

10. An electronic musical instrument as defined in claim 9 wherein at least said first and second tone signal generation means are formed on the same integrated circuit chip.

11. An electronic musical instrument as defined in claim 10 which further comprises distribution means formed on the integrated circuit chip for distributing said first and second envelope signals generated by said envelope generation means in a time division multiplexing manner to said first and second tone signal generation means, respectively.

12. An electronic musical instrument as defined in claim 8 wherein said first tone signal generation means comprises memory means prestoring waveform data of plural tone signal waveforms corresponding to various tone colors, reads from said memory means waveform data of a tone signal corresponding to a selected tone color and generates a tone signal on the basis of the read out waveform data, and said second tone signal generation means generates a tone signal by executing a predetermined tone synthesis operation.

13. An electronic musical instrument as defined in claim 12 wherein the predetermined tone synthesis operation in said second tone signal generation means is a tone synthesis operation of a frequency modulation type.

14. An electronic musical instrument as defined in claim 8 further comprising means for controlling a ratio of addition of the output tone signals of said first and second tone signal generation means in said digital addition means.

15. An electronic musical instrument as defined in claim 14 wherein said ratio of addition is changed over time.

16. An electronic musical instrument as defined in claim 8 further comprising mode selection means for selecting a mode, and supply control means for performing, in accordance with a mode selected by said mode selection means, a control for supplying the tone pitch designation information representing a tone pitch and generated by said tone pitch designation means to either or both of said first and second tone signal generation means.

17. An electronic musical instrument comprising:

tone pitch designation means for designating a tone pitch of a tone to be generated;

first tone signal generation means for generating a tone signal comprising of plural samples and having a pitch determined by supplied tone pitch designation information in accordance with an effective sampling frequency synchronized with the pitch and outputting the tone signal to a sampling timing based on a common first sampling frequency;

second tone signal generation means for generating a tone signal comprised of plural samples and having a pitch determined by supplied tone pitch designation information and outputting the tone signal at a second sampling frequency which is not synchronized with this pitch;

mode selection means for selecting a mode; and supply control means for performing, in accordance with a mode selected by said mode selection means, a control for supplying the tone pitch designation information representing a tone pitch designated by said tone pitch designation means to at least one of said first and second tone signal generation means, wherein a control for generating a tone signal of the same designated tone pitch in at least one of said first and second tone signal generation means is made in accordance with a mode selected by said mode selection means.

18. An electronic musical instrument as defined in claim 17 wherein said mode selection means selects either of a first mode and a second mode and said supply control means supplies said tone pitch designation information for all tone pitches to both of said first and second tone signal generation means when said first mode has been selected and supplies said tone pitch designation information to either said first tone signal generation means or said second tone signal generation means selectively in accordance with the tone pitch when said second tone mode has been selected.

19. A tone signal synthesizing device for synthesizing a tone signal by a modulation operation using a modulating wave signal and a modulated wave signal comprising:

a waveform table storing waveform data of a predetermined waveform shape in linear expression;

phase address signal supply means for supplying a phase address signal for at least one of a modulating wave signal and a modulated wave signal;

address conversion means for converting an address value of said phase address signal for each of plural phase sections which are portions of a phase of one cycle, in accordance with a conversion function established individually for each of said phase sections; and means for outputting waveform data having a waveform shape which is different from said predetermined waveform shape from said waveform table in response to said phase address signal by accessing said waveform table with the output of said address conversion means.

20. A tone signal synthesizing device as defined in claim 19 wherein said address conversion means converts the address value of the phase address signal by executing a predetermined operation established individually for each phase section using the phase address signal as an independent variable.

21. A tone signal synthesizing device as defined in claim 20 wherein said predetermined operation established individually for each phase section is a linear operation.

22. A tone signal synthesizing device as defined in claim 19 further comprising means for selecting whether said waveform table should be accessed by an address signal which has been converted by said address conversion means or a phase address signal which has not been converted by said address conversion means.

23. A tone signal synthesizing device as defined in claim 19 wherein said waveform table stores waveform data of a sine wave function.

24. An electronic musical instrument comprising:

tone pitch designation means for designating a tone pitch of a tone to be generated;

first tone signal generation means for generating, in accordance with a first tone generating technique, a tone signal having a pitch corresponding to the tone pitch designated by said tone pitch designation means;

second tone signal generation means for generating a tone signal having a pitch corresponding to the tone pitch designated by said tone pitch designation means in accordance with a second tone generating technique which is different from the first technique;

tone generation mode selection means for selecting a tone generation mode designating a combination of tone generation in said first and second tone signal generation means from among a plurality of different tone generation modes; and control means for controlling tone generation in said first and second tone signal generation means in accordance with the tone generation mode selected by said mode selection means.

25. An electronic musical instrument as defined in claim 24 which further comprises tone color selection means and wherein said first and second tone signal generation means generate tone signals having a tone color selected by said tone color selection means in accordance with tone signal generation techniques specific to the respective tone signal generation means and said tone generation mode selection means automatically selects a tone generation mode which is determined by the tone color selected by said tone color selection means.

26. An electronic musical instrument as defined in claim 24 wherein said tone generation mode selection means can select a desired tone generation mode by a manual selection operation by an operator.

27. An electronic musical instrument as defined in claim 24 wherein the plurality of tone generation modes from which a desired tone generation mode can be selected in said tone generation mode selection means comprise a simple mixing mode in which tones are sounded substantially simultaneously in said first and second tone signal generation means and a delay mode in which start of sounding of a tone in one of said first and second tone signal generation means is delayed from start of sounding of a tone in the other tone signal generation means.

28. An electronic musical instrument as defined in claim 24 wherein the plurality of tone generation modes from which a desired tone generation mode can be selected in said tone generation mode selection means comprise a simple mixing mode in which tones are sounded substantially simultaneously in said first and second tone signal generation means and a crossfade mode in which a tone signal is first generated in one of said first and second tone signal generation means and then generation of a tone is switched to the other tone signal generation means and a preceding tone signal is gradually attenuated and a succeeding tone signal is caused to rise gradually during the switching period.

29. An electronic musical instrument as defined in claim 24 wherein the plurality of modes from which a desired tone generation mode can be selected in said tone generation mode selection means comprise a delay mode in which start of sounding of a tone in one of said first and second tone signal generation means is delayed from start of sounding of a tone in the other tone signal generation means and a crossfade mode in which a tone signal is first generated in one of said first and second tone signal generation means and then generation of a tone signal is switched to the other tone signal generation means and a preceding tone signal is gradually attenuated gradually while a succeeding tone signal is caused to rise gradually during the switching period.

30. An electronic musical instrument comprising:

tone pitch designation means for designating a tone pitch of a tone to be generated;

first tone signal generation means for generating, in accordance with a first tone generating technique, a tone signal having a pitch corresponding to the tone pitch designated by said tone pitch designation means;

second tone signal generation means for generating a tone signal having a pitch corresponding to the tone pitch designated by said tone pitch designation means in accordance with a second tone generating technique which is different from the first technique;

crossfade control means for performing a control in which a tone signal is first generated in one of said first and second tone signal generation means and then generation of a tone signal is switched to the other tone signal generation means and a preceding tone is gradually attenuated while a succeeding tone is caused to rise gradually during a switching period; and time control means for variably controlling a time of the switching period.

31. An electronic musical instrument as defined in claim 30 wherein said time control means variably controls the time of the switching period and delay time from start of generation of the preceding tone signal till start of generation of the succeeding tone signal independently from each other.

32. An electronic musical instrument as defined in claim 30 which further comprises tone color selection means and wherein said first and second tone signal generation means generate tone signals having a tone color selected by said tone color selection means in accordance with tone signal generation techniques specific to the respective tone signal generation means and said time control means controls the time of the switching period in accordance with the tone color selected by said tone color selection means.

33. An electronic musical instrument as defined in claim 30 wherein said time control means comprises selection means for selecting the time of the switching period as desired.

34. An electronic musical instrument as defined in claim 30 wherein said time control means comprises means for supplying time data for establishing the time of the switching period and said crossfade control means comprises time counting means for establishing the switching period by performing repetitive counting in response to the time data and crossfade imparting means for imparting a decay envelope to the preceding tone signal and a rise envelope to the succeeding tone signal during the switching period.

35. An electronic musical instrument as defined in claim 34 wherein said first tone signal generation means comprises a count circuit for repetitively counting data corresponding to the designated tone pitch to generate phase address information and said time counting means uses this count circuit on a time shared basis.

36. An electronic musical instrument as defined in claim 34 which further comprises tone color selection means and wherein said first and second tone signal generation means generate tone signals having a tone color selected by said tone color selection means in accordance with tone signal generation techniques specific to the respective tone signal generation means and controls whether the control by said crossfade control means should be made or not in accordance with the tone color selected by said tone color selection means.

37. An electronic musical instrument comprising;

tone pitch designation means for designating a tone pitch of a tone to be generated;

first tone signal generation means for generating, in accordance with a first tone generating technique, a tone signal having a pitch corresponding to the tone pitch designated by said tone pitch designation means;

second tone signal generation means for generating a tone signal having a pitch corresponding to the tone pitch designated by said tone pitch designation means in accordance with a second tone generating technique different from the first technique; and delay means for delaying start of generation of a tone signal in one of said first and second tone signal generation means with respect to start of generation of a tone signal in the other tone signal generation means.

38. An electronic musical instrument as defined in claim 37 which further comprises tone color selection means and wherein said first and second tone signal generation means generate tone signals having a tone color selected by said tone color selection means in accordance with tone signal generation techniques specific to the respective tone signal generation means and perform a control as to whether delay should be applied by said delay means or not and a control to select one of said first and second tone signal generation means in which start of tone generation should be delayed.

39. An electronic musical instrument comprising:

tone pitch designation means for designating a tone pitch of a tone to be generated;

first tone signal generation means for generating, in accordance with a first tone generating technique, a tone signal having a pitch corresponding to the tone pitch designated by said tone pitch designation means;

second tone signal generation means for generating a tone signal having a pitch corresponding to the tone pitch designated by said tone pitch designation means in accordance with a second tone generating technique which is different from the first technique;

delay means for delaying start of generation of a tone signal in one of said first and second tone signal generation means with respect to start of generation of a tone signal in the other tone signal generation means; and time control means for variably controlling delay time in said delay means.

40. An electronic musical instrument as defined in claim 39 which further comprises tone color selection means and wherein said first and second tone signal generation means generate tone signals having a tone color selected by said tone color selection means in accordance with tone signal generation techniques specific to the respective tone signal generation means and said time control means controls the delay time in accordance with the tone color selected by said tone color selection means.

41. An electronic musical instrument as defined in claim 39 wherein said time control means comprises selection means for selecting the delay time as desired.

42. An electronic musical instrument as defined in claim 39 wherein said time control means comprises means for supplying time data for establishing the delay time and said delay means comprises time counting means for establishing the delay time by performing repetitive counting in accordance with the time data and means for imparting a tone generation start command first to the tone signal generation means in which tone generation should be made first and imparting a tone generation start command to the tone signal generation means in which tone generation should be made nextly when counting of the delay time by said time counting means has been completed.

43. An electronic musical instrument as defined in claim 42 wherein said first tone signal generation means comprises a count circuit for repetitively counting data corresponding to the designated tone pitch to generate phase address information and said time counting means uses this count circuit on a time shared basis.

44. An electronic musical instrument comprising:

tone pitch designation means for designating a tone pitch of a tone to be generated;

first tone signal generation means for generating, in accordance with a first tone generating technique, a tone signal having a pitch corresponding to the tone pitch designated by said tone pitch designation means;

second tone signal generation means for generating a tone signal having a pitch corresponding to the tone pitch designated by said tone pitch designation means in accordance with a second tone generating technique which is different from the first technique;

means for generating a key-on pulse designating start of tone generation in response to designation of a tone pitch in said tone pitch designation means; and key-on pulse distribution means for distributing this key-on pulse to at least one of said first and second tone signal generation means to start generation of a tone signal in the tone signal generation means to which the key-on pulse has been distributed.

45. An electronic musical instrument as defined in claim 44 which further comprises delay control means for performing a control to delay start of generation of a tone signal in one of said tone signal generation means with respect to start of generation of a tone signal in the other tone signal generation means and wherein said key-on pulse distribution means distributes the key-on pulse to the tone signal generation means in which tone generation is started first when the delay control is made by said delay control means and distributes the key-on pulse to both of the tone signal generation means when the delay control is not made.

* * * * *